US012492601B2

(12) United States Patent
Olguin et al.

(10) Patent No.: US 12,492,601 B2
(45) Date of Patent: Dec. 9, 2025

(54) ANTI-PRESET LINER HANGER SYSTEMS

(71) Applicant: National Oilwell Varco, L.P., Houston, TX (US)

(72) Inventors: Fernando Olguin, Houston, TX (US); Joshua Hein, Houston, TX (US); Jake Hardy, Houston, TX (US); Aju Abraham, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 19/190,401

(22) Filed: Apr. 25, 2025

(65) Prior Publication Data

US 2025/0334010 A1 Oct. 30, 2025

Related U.S. Application Data

(60) Provisional application No. 63/639,448, filed on Apr. 26, 2024.

(51) Int. Cl.
*E21B 23/04* (2006.01)

(52) U.S. Cl.
CPC ..... *E21B 23/0411* (2020.05)

(58) Field of Classification Search
CPC ..... E21B 23/01; E21B 23/0411
See application file for complete search history.

(56) References Cited

U.S. PATENT DOCUMENTS 5,560,426 A * 10/1996 Trahan ..... E21B 23/042 166/182
2003/0034156 A1* 2/2003 Gondouin ..... E21B 7/065 166/117.5
2012/0285703 A1* 11/2012 Abraham ..... E21B 23/042 166/120
2015/0101827 A1* 4/2015 Abraham ..... E21B 23/01 166/85.1
2015/0136393 A1* 5/2015 Turley ..... E21B 23/00 166/382

(Continued)

*Primary Examiner* — Shane Bomar
(74) *Attorney, Agent, or Firm* — Conley Rose, P.C.

(57) ABSTRACT

A liner hanger system deployable in a wellbore penetrating an earthen subterranean formation, the liner hanger system comprising a liner hanger installable in the wellbore and comprising one or more slips each having a radially inner run-in position and a radially outer set position configured to couple the liner hanger to a downhole tubular member located in the wellbore, and a sealing element comprising a radially contracted configuration and a radially expanded configuration configured to seal against an inner surface of the downhole tubular member, a setting tool and a bore receptacle each configured to connect to the liner hanger wherein the setting tool and the bore receptacle are collectively configured to shift the one or more slips from their run-in positions to their set positions, and the sealing element from the contracted configuration to the expanded configuration in response to receiving one or more activation signals, and a locking tool configured to connect to the setting tool and the bore receptacle whereby the setting tool and the bore receptacle are each positioned axially between the locking tool and the liner hanger with the setting tool at least partially received within the bore receptacle.

20 Claims, 13 Drawing Sheets

(56) References Cited

U.S. PATENT DOCUMENTS

| | | | | |
|---|---|---|---|---|
| 2016/0130896 | A1* | 5/2016 | Halfmann | E21B 23/06<br>166/208 |
| 2022/0025724 | A1* | 1/2022 | Goad, Jr. | E21B 23/04 |
| 2023/0033711 | A1* | 2/2023 | Kalb | E21B 23/0411 |
| 2024/0384629 | A1* | 11/2024 | Themig | E21B 23/01 |

* cited by examiner

ANTI-PRESET LINER HANGER SYSTEMS

CROSS-REFERENCE TO RELATED APPLICATIONS

This application claims benefit of U.S. provisional patent application No. 63/639,448 filed Apr. 26, 2024, entitled "Anti-Preset Liner Hanger Systems", which is incorporated herein in its entirety for all purposes.

STATEMENT REGARDING FEDERALLY SPONSORED RESEARCH OR DEVELOPMENT

Not applicable.

BACKGROUND

The present disclosure pertains to liner hanger systems utilized in the oil and gas industry for installing liner hangers downhole within wellbores, particularly those intended for hydrocarbon production. Liner hanger systems play a pivotal role in the construction and completion of wellbores that extend from a terranean surface through an earthen subterranean formation, ensuring the integrity and stability of the casing assembly within the wellbore. These systems are instrumental in suspending and sealing liners or casing strings in the wellbore, allowing for the subsequent drilling, completion, and production phases.

SUMMARY

An embodiment of a liner hanger system deployable in a wellbore penetrating an earthen subterranean formation comprises a liner hanger installable in the wellbore and comprising one or more slips each having a radially inner run-in position and a radially outer set position configured to couple the liner hanger to a downhole tubular member located in the wellbore, and a sealing element comprising a radially contracted configuration and a radially expanded configuration configured to seal against an inner surface of the downhole tubular member, a setting tool and a bore receptacle each configured to connect to the liner hanger wherein the setting tool and the bore receptacle are configured to shift the one or more slips from their radially inner run-in positions to their radially outer set positions, and the sealing element from the radially contracted configuration to the radially expanded configuration in response to receiving one or more activation signals, and a locking tool configured to connect to the setting tool and the bore receptacle whereby the setting tool and the bore receptacle are each positioned axially between the locking tool and the liner hanger with the setting tool at least partially received within the bore receptacle, wherein the locking tool is shiftable downhole between a locked state and an unlocked state, wherein the locked state of the locking tool locks the locking tool to the bore receptacle and prevents at least one of the one or more slips from shifting from their radially inner run-in positions to their radially outer set positions and the sealing element from shifting from the radially contracted configuration to the radially expanded configuration in response to receiving the one or more activation signals, wherein the unlocked state of the locking tool permits the shifting of the one or more slips from their radially inner run-in positions to their radially outer set positions and/or the shifting of the sealing element from the radially contracted configuration to the radially expanded configuration prevented by the locking tool when in the locked state, and wherein the unlocked state unlocks the locking tool from the bore receptacle whereby the locking tool and the setting tool is each disconnectable from the bore receptacle. In some embodiments, the locking tool blocks passage of at least one of the one or more activation signals across the locking tool to the setting tool or the bore receptacle when in the locked state, and wherein the locking tool permits the passage of the at least one of the one or more activation signals across the locking tool when in the unlocked state. In some embodiments, the locking tool and the setting tool are permitted to travel uphole relative to the bore receptacle and the liner hanger when the locking tool is in the unlocked state. In certain embodiments, at least one of the one or more activation signals is hydraulic and wherein at least one of the one or more activation signals is mechanical. In certain embodiments, the locking tool comprises a mandrel coupled to the setting tool and a setting sleeve positioned around the mandrel and coupled to the bore receptacle when the locking tool is in the locked state. In some embodiments, the locking tool comprises a locking shoulder that restricts relative axial movement between the mandrel and the setting sleeve when the locking tool is in the locked state and permits relative axial movement between the mandrel and the setting sleeve when the locking tool is in the unlocked state. In some embodiments, the locking tool comprises a setting piston positioned radially between the mandrel and the setting sleeve, wherein the setting piston is configured to apply a first axially directed force through the setting sleeve and the bore receptacle to the liner hanger in response to the locking tool receiving the one or more activation signals. In certain embodiments, the mandrel is configured to apply a second axially directed force to the liner hanger, independent of the first axially directed force, in response to the locking tool receiving the one or more activation signals.

An embodiment of a locking tool for a liner hanger system deployable in a wellbore penetrating an earthen subterranean formation comprises a mandrel comprising an uphole end configured to couple to a conveyance string for deploying the liner hanger system into the wellbore, a longitudinally opposed downhole end configured to connect to a setting tool for setting at least one of one or more slips and a sealing element of a liner hanger of the liner hanger system, a central passage extending between the uphole end and the downhole end, and a radial port in fluid communication with the central passage, a setting sleeve positioned around the mandrel and comprising an uphole end and a longitudinally opposed downhole end configured to connect to a bore receptacle of the liner hanger system, wherein the setting tool and the bore receptacle are collectively configured to shift one or more slips of a liner hanger of the liner hanger system from radially inner run-in positions to radially outer set positions configured to couple the liner hanger to a downhole tubular member located in the wellbore, and a sealing element of the liner hanger from a radially contracted configuration to a radially expanded configuration configured to seal against an inner surface of the downhole tubular member in response to receiving one or more control signals, and a setting piston positioned radially between the setting sleeve and the mandrel whereby an expansion chamber is formed radially between the setting piston and the mandrel and in fluid communication with the radial port, wherein the setting piston is configured, in response to pressurizing the expansion chamber via communication of a control signal to the locking tool, to apply a downhole axially directed force through the setting sleeve to the bore receptacle when the bore receptacle is connected to the locking tool. In certain embodiments, the locking tool comprises an isolation sleeve slidably positioned in the central passage of the mandrel, the isolation sleeve comprising a first position in the central passage sealing the radial port from the central passage and a second position in the central passage, spaced from the first position, permitting fluid communication between the central passage and the radial port. In some embodiments, the locking tool comprises an expandable obturating receptacle connected to the isolation sleeve when the isolation sleeve is in the first position and disconnected from the isolation sleeve when the isolation sleeve is in the second position. In some embodiments, the locking tool comprises a stroke limiter coupled to a radially outer surface of the setting piston and configured to contact a shoulder of the setting sleeve to delimit downhole travel of the setting piston relative to the mandrel. In certain embodiments, the locking tool comprises a support sleeve coupled to a downhole end of the setting piston by an adjustable connection configured to adjust an axial projection of a downhole end of the support sleeve relative to the downhole end of the setting piston. In certain embodiments, the locking tool comprises a support sleeve coupled to a downhole end of the setting piston and comprising a radially outer shoulder configured to prevent disconnection of the setting sleeve from the bore receptacle when the setting piston is in a run-in position and to permit disconnection of the setting sleeve from the bore receptacle when the setting piston is in a stroked position that is axially spaced from the run-in position relative to the mandrel. In some embodiments, the outer shoulder of the support sleeve axially overlaps the downhole end of the setting sleeve when the setting piston is in the run-in position and is axially spaced from the downhole end of the setting sleeve when the setting piston is in the stroked position. In some embodiments, the locking tool comprises one or more locking dogs positioned radially between the setting sleeve and the mandrel, wherein the one or more locking dogs each comprise a radially inner position defining a load shoulder delimiting downhole axial travel of the setting sleeve relative to the mandrel, and a radially outer position eliminating the load shoulder.

An embodiment of a method for installing a liner hanger in a wellbore penetrating an earthen subterranean formation comprises (a) deploying a liner hanger system comprising the liner hanger into the wellbore, the liner hanger system being coupled to a downhole end of a conveyance string extending from a surface assembly, (b) transmitting one or more unlocking signals from the surface assembly to a locking tool of the liner hanger system to shift the locking tool in the wellbore from a locked state preventing shifting of the liner hanger to a set configuration coupled to a downhole tubular member positioned in the wellbore to an unlocked state permitting the shifting of the liner hanger to the set configuration, (c) transmitting one or more activation signals from the surface assembly, through the locking tool, to at least one of a bore receptacle and a setting tool of the liner hanger system each coupled axially between the locking tool and the liner hanger whereby the bore receptacle and the setting tool collectively shift the liner hanger to the set configuration, and (d) disconnecting from the liner hanger and the bore receptacle and retrieving to a terranean surface the locking tool and the setting tool with the liner hanger in the set configuration in the wellbore. In certain embodiments, at least one of the one or more unlocking signals and at least one of the one or more activation signals are generated by a fluid pump of the surface assembly. In certain embodiments, the one or more activation signals are transmitted as one or more axially directed forces through the bore receptacle to the liner hanger. In some embodiments, (a) comprises transmitting one or more axially directed forces along a load path extending from an inner mandrel of the locking tool, through a load shoulder defined by one or more locking dogs of the locking tool, and to an outer setting sleeve of the locking tool slidably positioned around the mandrel.

BRIEF DESCRIPTION OF THE DRAWINGS

For a detailed description of disclosed embodiments, reference will now be made to the accompanying drawings in which.

DETAILED DESCRIPTION

Figure 1:
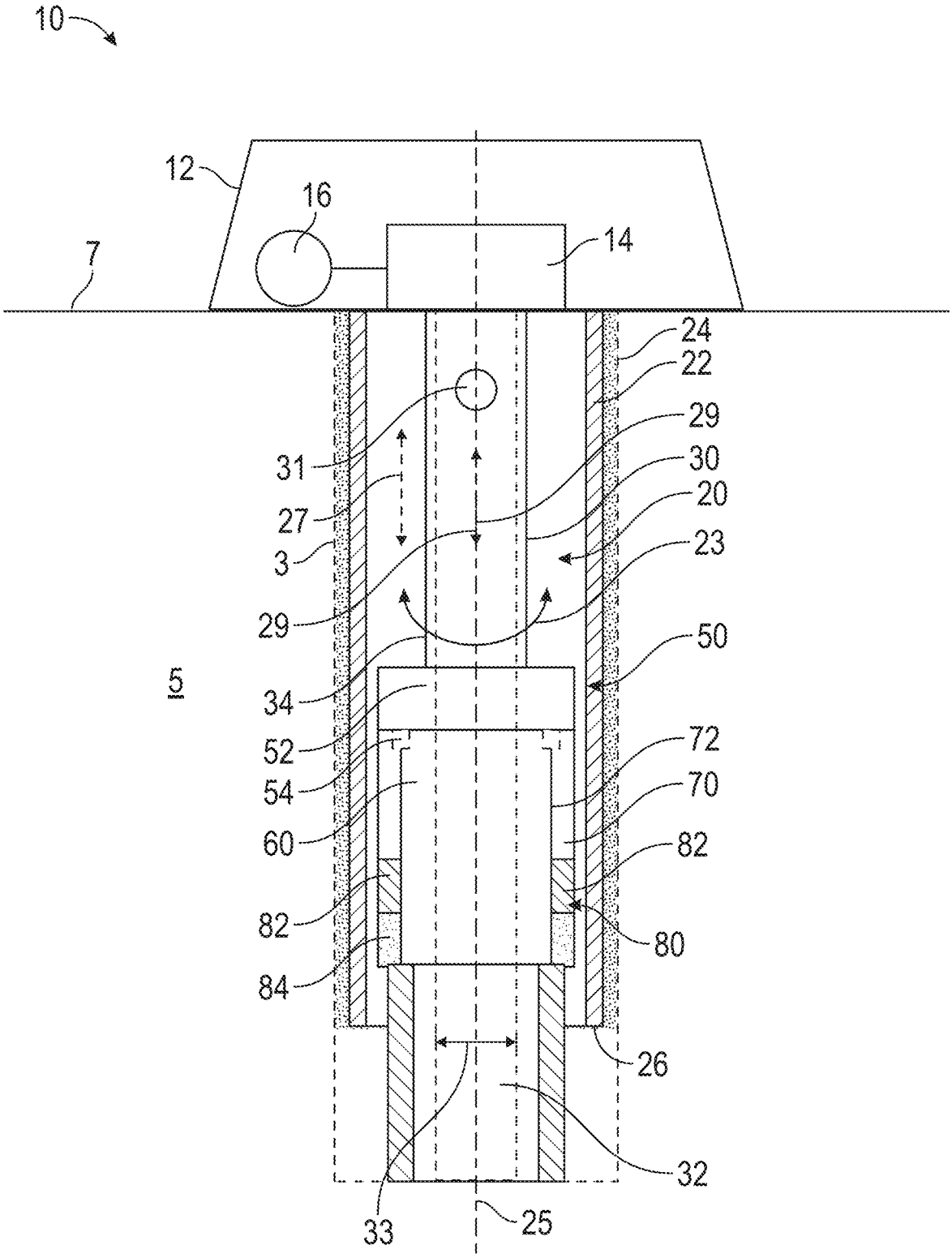
FIGS. 1-3 are schematic views of an embodiment of a well system in accordance with principles disclosed herein.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the wellbore and with "down", "lower", "downwardly", "downhole", or "downstream" meaning toward the terminal end of the wellbore, regardless of the wellbore orientation.

As described above, liner hanger systems play a pivotal role in constructing wellbores penetrating earthen subterranean formations. Particularly, in many applications at least a portion of the inner wall of the wellbore is lined with one or more downhole tubular members or liners which may be in the form of casing joints, production liners, and the like, which physically support the wellbore and at least in some instances serve to seal the surrounding formation (e.g., via cement pumped in the annulus formed between the wellbore wall and the liner) and thereby prevent unintentional fluid flow between the subterranean formation and the wellbore.

Typically, at least some of the liners (e.g., casing hangers) of a given well system are physically supported at the terranean surface such as at or near the wellhead. However, wellbores can extend to significant depths, often several thousand feet or more below the surface. Suspending each of the liners of such a well system at the terranean surface would require extremely long casing strings, which can be impractical (e.g., the resulting flow area of the completed wellbore may be too small) and technically challenging to handle and deploy. Thus, in some applications, some of the liners lining the wall of the wellbore are instead physically supported or suspended at locations within the wellbore itself beneath the terranean surface. For example, a liner hanger coupled to an uphole end of a downhole liner (e.g., a production liner) may couple or attach to an inner surface at a downhole end of an uphole liner (e.g., a casing string) whereby the uphole liner may physically support the downhole liner via the liner hanger coupled therebetween.

"Liner hanger systems" refer to systems used to install liner hangers (and their associated liner) downhole in wellbores including both physically coupling or securing the liner hanger to an uphole liner (e.g., a downholemost casing joint of a casing string) in the wellbore whereby the weight of the liner hanger (and its associated liner) is supported by the uphole liner, and sealing the connection formed between the uphole liner and the liner hanger. Traditionally, liner hanger systems have relied on mechanical or hydraulic mechanisms to anchor the liner hanger in place within the wellbore.

Generally, liner hanger systems function through the use of setting tools, bore receptacles sometimes referred to as polished bore receptacles (PBRs), and slips. The setting tool of the mechanical liner hanger system, typically run on a work string or coiled tubing, is engaged at the surface to deploy the liner hanger assembly to the desired depth within the wellbore. Upon reaching the designated depth, the setting tool triggers the release of slips which radially expand to firmly grip and bite into the inner surface of the uphole liner. This anchoring action secures the liner hanger in place, providing support and sealing integrity. In addition, following setting of the slips, the setting tool triggers the release of a sealing element of the liner hanger which radially expands into sealing contact with the uphole liner to seal the connection formed between the uphole liner and the liner hanger. In some instances, conventional setting tool includes an anti-presetting mechanism configured to prevent the setting tool from inadvertently setting the liner hanger prior to reaching the desired depth.

Generally, setting tools of conventional liner hanger systems at least partially remain in the wellbore following installation of the liner hanger and are not retrieved back to the terranean surface, instead remaining permanently installed in the wellbore. This may be done out of convenience in order to axially position certain components of the setting tool relative to other components of the liner hanger and/or the bore receptacle. However, any components of the setting tool that remain in the wellbore must necessarily axially overlap with at least one of the bore receptacle and the liner hanger coupled to the downhole end thereof. This axial overlap with components of the setting tool and the bore receptacle and/or liner hanger consequently reduces a flow area of a flow passage of the liner hanger, which in-turn reduces the production capacity of the wellbore during the production phase thereof.

Accordingly, embodiments of liner hanger systems and methods for installing liner hangers are disclosed herein configured to address at least these issues of conventional liner hanger systems. Particularly, embodiments of liner hanger systems disclosed herein include a locking tool located uphole from a bore receptacle and a liner hanger of the liner hanger system, the locking tool configured to prevent presetting of the liner hanger at a location in the wellbore other than the desired depth. In this configuration, the locking tool as well as a setting tool of the liner hanger system coupled to the locking tool (e.g., to a downhole end thereof) may be retrieved from the wellbore such that they or components thereof do not remain in the wellbore in axial overlap with the bore receptacle and/or liner hanger. In this manner, the flow area of the liner hanger may be maximized, in-turn maximizing the production capacity of the wellbore.

Referring to FIG. 1, an embodiment of a well system 10 is shown including a wellbore 3 penetrating an earthen subterranean formation 5 located beneath a terranean surface 7. Well system 10 generally includes a surface assembly 12 located at the terranean surface 7, and a downhole assembly 20 generally including a casing string 22 extending into the wellbore 3 from the surface assembly 12, a conveyance string 30 extending into the wellbore 3 from the surface assembly 12, and a liner hanger system 50 coupled to and supported by the conveyance string 30.

The surface assembly 12 of well system 10 is configured for deploying the downhole assembly 20 into the wellbore 3 and for applying control signals to the liner hanger system 50 as will be described further herein. For example, in this exemplary embodiment, surface assembly 12 includes a rotational assembly 14 and a fluid pump 16. Rotational assembly 14 (e.g., a top drive assembly and the like) is configured to apply a torque to the downhole assembly 20 around a longitudinal or central axis 25 of downhole assembly 20 in one or both rotational directions (e.g., the clockwise and/or counterclockwise rotational directions) as indicated by arrow 23 in FIG. 1. In some embodiments, rotational assembly 14 is also configured to apply an axially directed (e.g., parallel with central axis 25) force in one of or both axial directions (e.g., in the uphole and/or downhole directions) as indicated by arrow 27 in FIG. 1.

The fluid pump 16 of surface assembly 12 is configured to pump fluid into and/or from a fluid passage 32 (indicated by arrow 29 in FIG. 1) of the downhole assembly 20 shared by the conveyance string 30 and liner hanger system 50. In addition, fluid pump 16 may be used to pump downhole tools into and through the wellbore 3 such as one or more obturating members (e.g., balls, darts) 31 which may, in some embodiments, may be used to activate one or more components of liner hanger system 50 (e.g., via creating a pressure differential thereacross upon landing against a seat of the liner hanger system 50).

The casing string 22 of downhole assembly 20 seals an uphole section of the wellbore 3 from the surrounding subterranean formation 5 via a sealant (e.g., cement) 24 filling the annulus between a wall of the wellbore 3 and an outer surface of the casing string 22. In addition, a first or uphole end of the casing string 22 is physically supported (e.g., suspended) from the terranean surface 7 by the surface assembly 12 such as via a wellhead, a casing hanger, and the like of surface assembly 12. An opposing second or downhole end 26 of casing string 22 is suspended in the wellbore 3 with the portion of the wellbore 3 extending downhole from the downhole end 26 of casing string 22 being "openhole" or exposed to the subterranean formation 5 in this exemplary embodiment.

The conveyance string 30 comprises fluid passage 32 as described above and is used to convey the liner hanger system 50 into and (at least components of liner hanger system 50) from wellbore 3 and for communicating control signals to the liner hanger system 50 in the form of rotational torque 23, axial force 27, fluid flow and/or pressure 29, and/or obturating members 31. In this exemplary embodiment, conveyance string 30 comprises a plurality of tubular joints such as pipe joints connected end-to-end at releasable, sealed connections (e.g., rotary threaded connections) formed therebetween. However, the configuration of conveyance string 30 may vary in other embodiments. For example, in other embodiments, conveyance string 30 may comprise a continuous flexible tubular member such as coiled tubing and the like.

The liner hanger system 50 of well system 10 is connected to a downhole end 34 of the conveyance string 30 of downhole assembly 20 whereby the liner hanger system 50 may be transported or run into wellbore 3. In this exemplary embodiment, liner hanger system 50 generally includes a locking tool 52, a setting tool 60, a bore receptacle 70, and a liner hanger 80. In other embodiments, liner hanger system 50 may include equipment (e.g., running tools, wipers) not shown in FIG. 1.

As will be discussed further herein, setting tool 60 (along with bore receptacle 70 in some embodiments) is generally configured to facilitate the setting of liner hanger 80 at a desired location or depth in the wellbore 3 (e.g., proximal the downhole end 26 of casing string 22). The locking tool 52 of liner hanger system 50 is generally configured to prevent the inadvertent premature activation or "presetting" of the setting tool 60 prior to liner hanger system 50 reaching the desired location in the wellbore 3.

Particularly, the locking tool 52 may prevent the presetting of setting tool 60 by preventing the setting tool 60 (or one or more selected components thereof) from travelling along central axis 25 relative to bore receptacle 70 until a predefined (e.g., a unique) unlocking signal is communicated from the surface assembly 12, through or along the conveyance string 30, and to the locking tool 52 to transition the locking tool 52 in the wellbore 3 from a first or locked state preventing the activation of setting tool 60 and an unlocked state permitting (e.g., in response to the communication of one or more control signals downhole from surface assembly 12 to liner hanger system 50) the activation of setting tool 60 and, in-turn, the setting of liner hanger 80 whereby liner hanger 80 is transitioned from a run-in configuration to a set configuration coupled to a tubular member in the wellbore 3 such as, for example, casing string 22.

Locking tool 52 includes a locking element 54 coupled between setting tool 60 and bore receptacle 70 when in a locked position (shown in FIG. 1) to axially lock the setting tool 60 with the bore receptacle 70. Locking element 54 also includes an unlocked position that is spaced from the locked position and which axially unlocks the setting tool 60 from the bore receptacle 70. The locked position of locking element 54 thus corresponds to the locked state of locking tool 52 while the unlocked position of locking element 54 corresponds to the unlocked state of locking tool 52. The locking element 54 may be shifted from the locked position to the unlocked position in response to communicating the unlocking signal from surface assembly 12 to the locking tool 52.

The unlocking signal may correspond to a change in fluid pressure or flow in fluid passage 32 as provided by fluid pump 16, rotational torque or motion (in one or both rotational directions) applied to locking tool 52 through the operation of rotational assembly 14, axial force or motion (in one or both axial directions) applied to locking tool 52 through the operation of surface assembly 12, and/or the receiving by the locking tool 52 of one or more obturating members 31 launched from surface assembly 12. In some applications, this unlocking signal may be unique, different, or at least separate from the control signals or signals used to activate the setting tool 60 to transition the liner hanger 80 from the run-in configuration to the set configuration. Locking element 54 may comprise a single member (e.g., a piston, a mandrel, a collet, a shear member such as a shear pin or ring) or an assembly of different members with one or more of those different members moving from the locked position to the unlocked position. The communication of the unlocking signal to the locking tool 52 from surface assembly 12 may apply an unlocking force (e.g., a predefined unlocking force in the form of a hydraulic force, a contact force) to the locking element 54 to forcibly shift the locking element 54 from the locked position to the unlocked position.

In this exemplary embodiment, locking tool 52 of liner hanger system 50 is coupled between (e.g., along central axis 25) the downhole end 34 of conveyance string 30 and each of the setting tool 60, bore receptacle 70, and liner hanger 80 such that locking tool 52 is positioned uphole in wellbore 3 from components 60, 70, and 80. In this arrangement, control signals generated by surface assembly 12 and communicated along conveyance string 30 are also communicated along or through locking tool 52 prior to being received by setting tool 60 and bore receptacle 70 which are located downhole from the locking tool 52. In this manner, locking tool 52 and setting tool 60 may each be retrieved from the wellbore 3 using conveyance string 30 following the setting of liner hanger 80 such that a minimum inner diameter (ID) 33 of fluid passage 32 may be maximized, maximizing in-turn the potential production flowrate of the well system 10 following completion. In addition to maximizing the minimum ID 33 of fluid passage 32, removing the locking tool 52 and setting tool 60 following installation of liner hanger 80 also minimizes the number of sealing points of liner hanger system 50 that must remain in the wellbore 3 following installation of liner hanger 80. For instance, if locking tool 52 and/or setting tool 60 remained in the wellbore (e.g., due to these components being located downhole from the bore receptacle 70) then additional seals would be required to seal the interfaces formed between tools 52, 60, and liner hanger 80 which could undesirably fail at some later point in time.

As described above, setting tool 60 facilitates the setting of liner hanger 80 at the desired location in the wellbore 3. For example, setting tool 60 may comprise one or more members (e.g., one or more housings, pistons, mandrels, obturating member seats, collets, a shear member such as a shear pin or ring) responsive to control signals provided from the surface assembly 12 and communicated through the conveyance string 30 to transition the liner hanger 80 from the run-in configuration to the set configuration. In some embodiments, a plurality of separate or discrete control signals (e.g., generated/communicated at different points in time) are communicated from the surface assembly 12, communicated through the conveyance string 30, and received by the setting tool 60 to set the liner hanger 80.

In this exemplary embodiment, bore receptacle 70 remains in the wellbore 3 following the installation of liner hanger 80 at an uphole end thereof. Bore receptacle 70 defines a sealing surface 72 (e.g., a generally cylindrical inner surface) which may be specifically machined or otherwise configured to effect a robust seal within the wellbore 3 such as additional auxiliary equipment of well system 10 not shown in FIG. 1. For example, in some instances, a downhole end of a production tubing string may be stabbed into the uphole end of the bore receptacle 70 establishing a seal against the sealing surface 72 thereof whereby a continuous conduit for produced fluids may be furnished.

In this exemplary embodiment, liner hanger 80 generally includes one or more radially displaceable slips 82, an annular sealing element 84 (e.g., an elastomeric sealing element or packer, a metallic sealing element), and a mandrel or liner 86 extending downhole to a downhole terminal end of the liner hanger 80. Each slip 82 includes a radially inner run-in position corresponding to the run-in configuration of liner hanger 80 and a radially outer set position corresponding to the set configuration of liner hanger 80. In the radially inner position, radial clearance is provided between a given slip 82 and the casing string 22 permitting liner hanger 80 to be transported through casing string 22. However, upon shifting into the radially outer position, the slip 82 contacts and bites (e.g., via teeth or other engagement members located on a radially outer periphery of the slip 82) into the inner surface of the casing string 22 thereby coupling or attaching liner hanger 80 to the casing string 22 such that casing string 22 may support the weight of liner hanger 80.

The sealing element 84 of liner hanger 80 seals the interface or connection formed between casing string 22 and liner hanger 80. Liner hanger 80 may not include sealing element 84 in applications where it not desired to seal the connection between casing string 22 and liner hanger 80. Sealing element 84 includes a radially contracted configuration corresponding to the run-in configuration of liner hanger 80 and a radially expanded configuration corresponding to the set configuration of liner hanger 80. In the contracted configuration, radial clearance is provided between sealing element 84 and the casing string 22 permitting liner hanger 80 to be transported through casing string 22. However, upon shifting into the expanded configuration, sealing element 84 sealingly engages or contacts the inner surface of the casing string 22 thereby sealing the annular interface formed between liner hanger 80 and casing string 22.

The slips 82 and sealing element 84 of liner hanger 80 may be set (e.g., individually set) by the locking tool 52, setting tool 60, and bore receptacle 70 via control signals provided by the surface assembly 12 and communicated downhole to the liner hanger system 50 via conveyance string 30. These control signals may be mechanical such as rotational torque 23 and axial force 27 and/or hydraulic such as fluid flow and/or pressure 29 or the communication or obturating members 31. The locking tool 52 may act as an interface for communicating these control signals to the setting tool 60 and/or bore receptacle 70.

Figure 2:
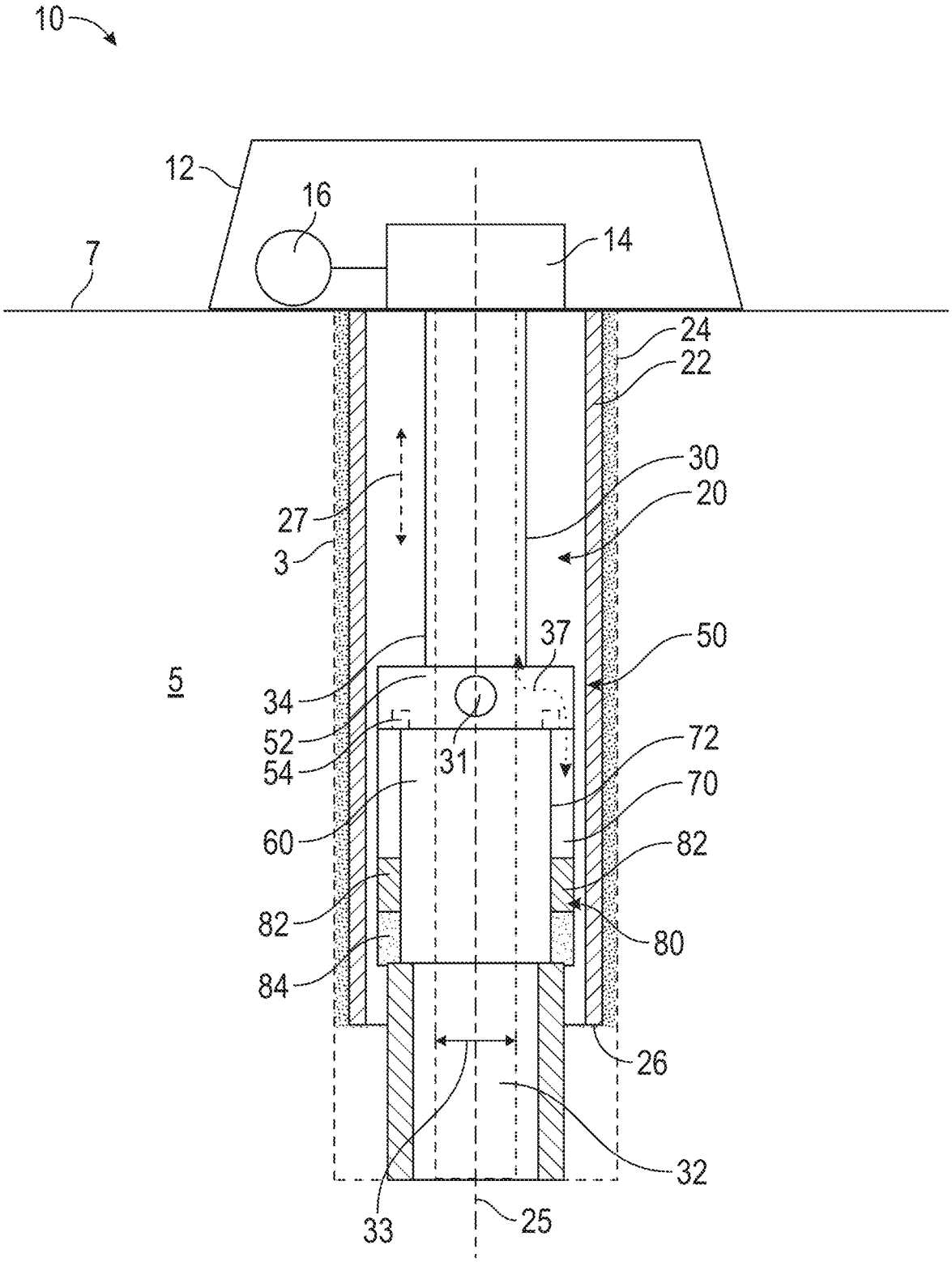

Referring now to FIG. 2, well system 10 is shown following the transmission of a predefined unlocking signal from the surface assembly 12 to the locking tool 52 of liner hanger system 50 shifting the locking tool 52 from the locked state shown in FIG. 1 (with locking elements 54 in their locked positions) to the unlocked state shown in FIG. 2 (with locking elements 54 in their unlocked positions) whereby relative movement along central axis 25 is permitted between setting tool 60 and bore receptacle 70. In this configuration, control signals provided by the surface assembly 12 may be applied to the setting tool 60 through the locking tool 52. For example, obturating members 31 may be landed in the setting tool 60, and fluid pressure and/or flow may be adjusted in the fluid passage 32 in a manner that is communicated through the locking tool 52 (e.g., via the fluid passage 32 of locking tool 52) and to the setting tool 60. In addition, in this exemplary embodiment, control signals or signals may be applied to and communicated through the bore receptacle 70 from the locking tool 52 (as indicated by arrow 37 in FIG. 2 which extends between conveyance string 30 and bore receptacle 70 through the locking tool 52). For example, in some embodiments, the control signal 37 may comprise an axially directed force and/or motion in the uphole or downhole directions (e.g., axial force 27 shown in FIG. 1) and/or a rotational torque (e.g., rotational torque 23 shown in FIG. 1).

Figure 3:
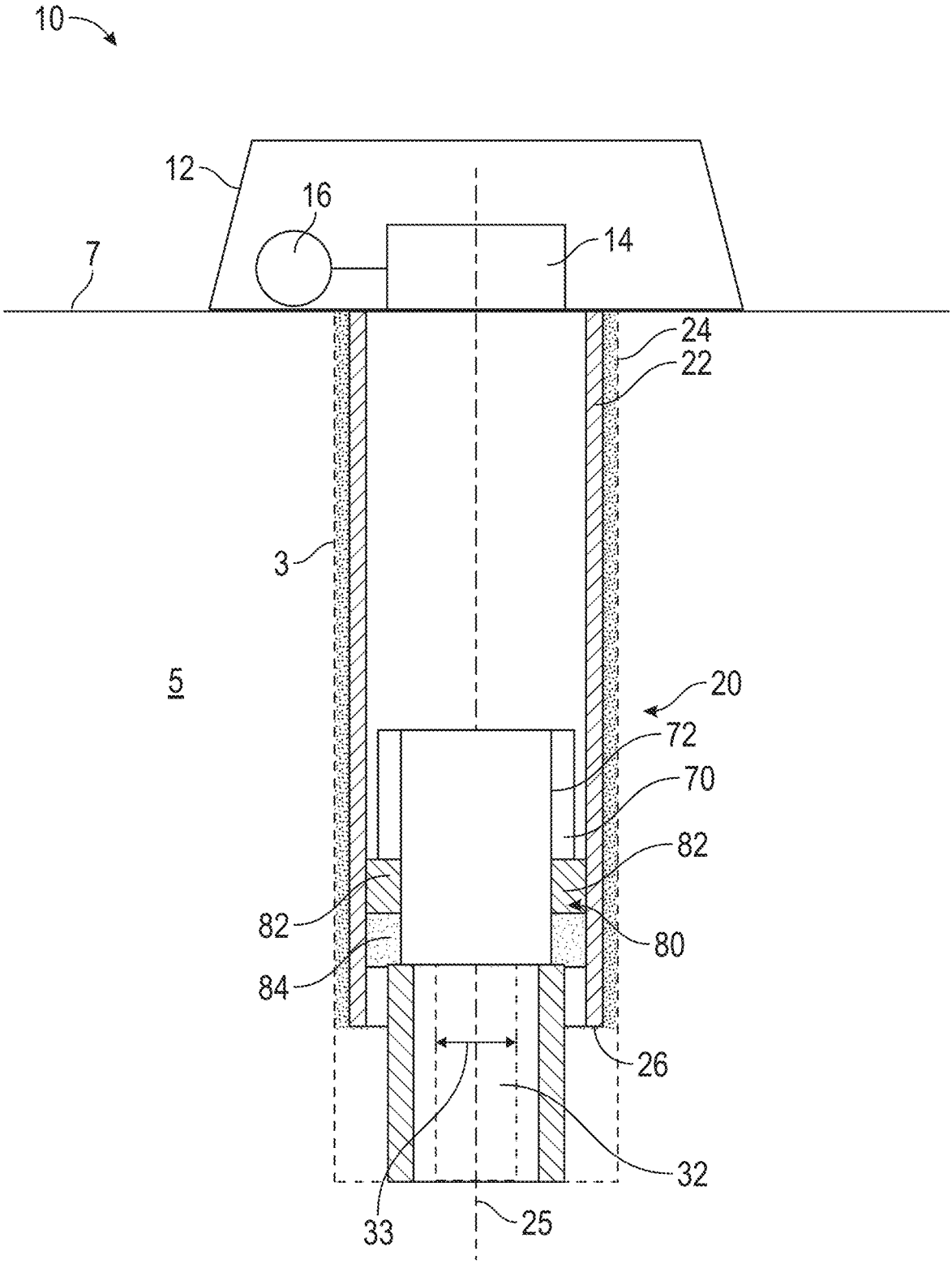
Figure 4:
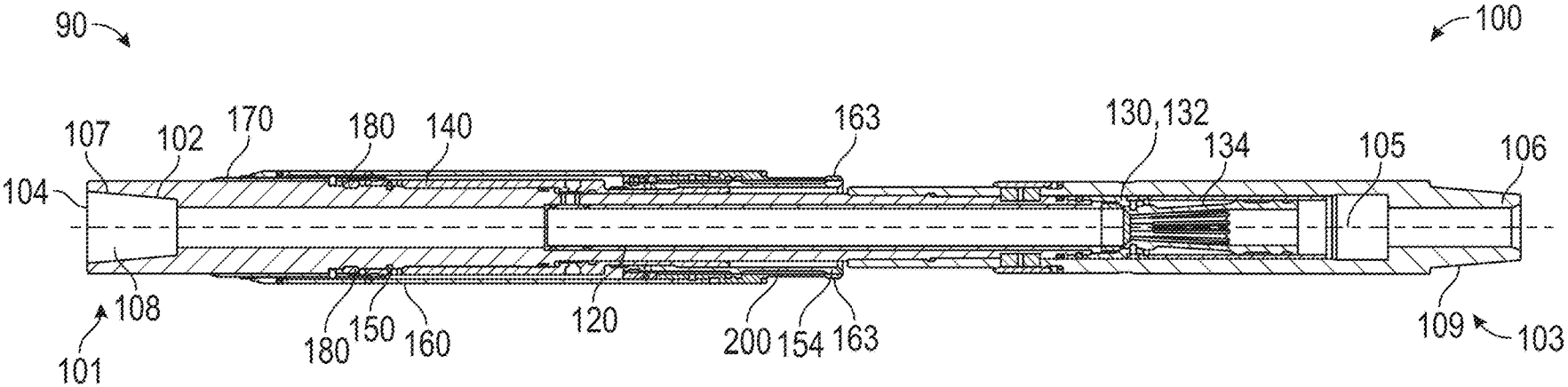
FIG. 4 is a side cross-sectional view of an embodiment of a well liner hanger system in accordance with principles disclosed herein.
Figure 5:
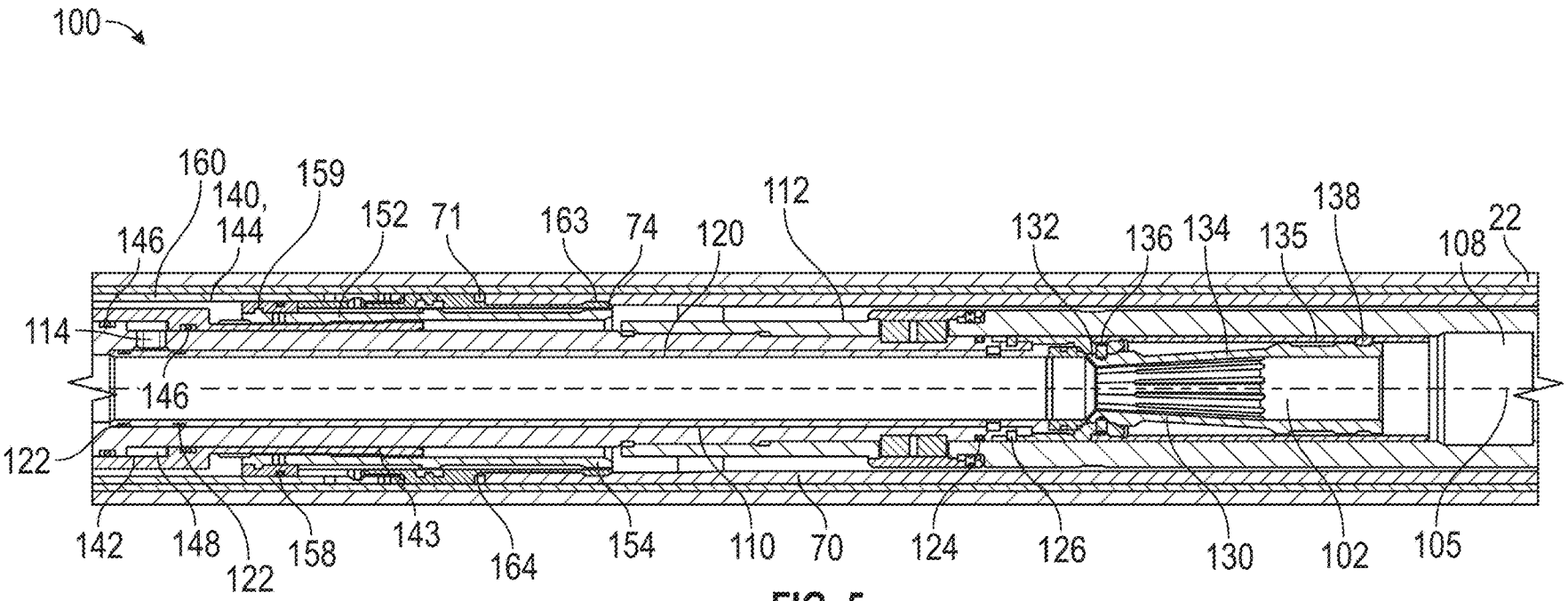
FIGS. 5-8 are partial, side cross-sectional views of an embodiment of a locking tool of the well liner hanger system of FIG. 4 in accordance with principles disclosed herein.
Figure 6:
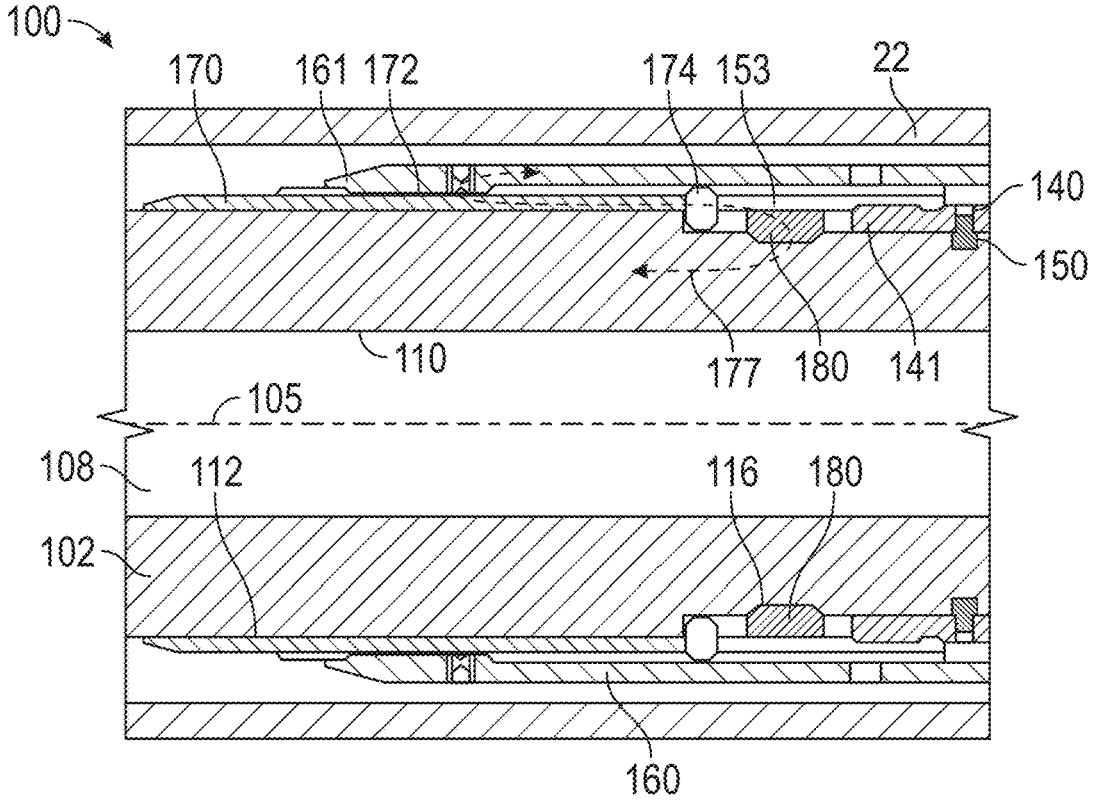
Figure 7:
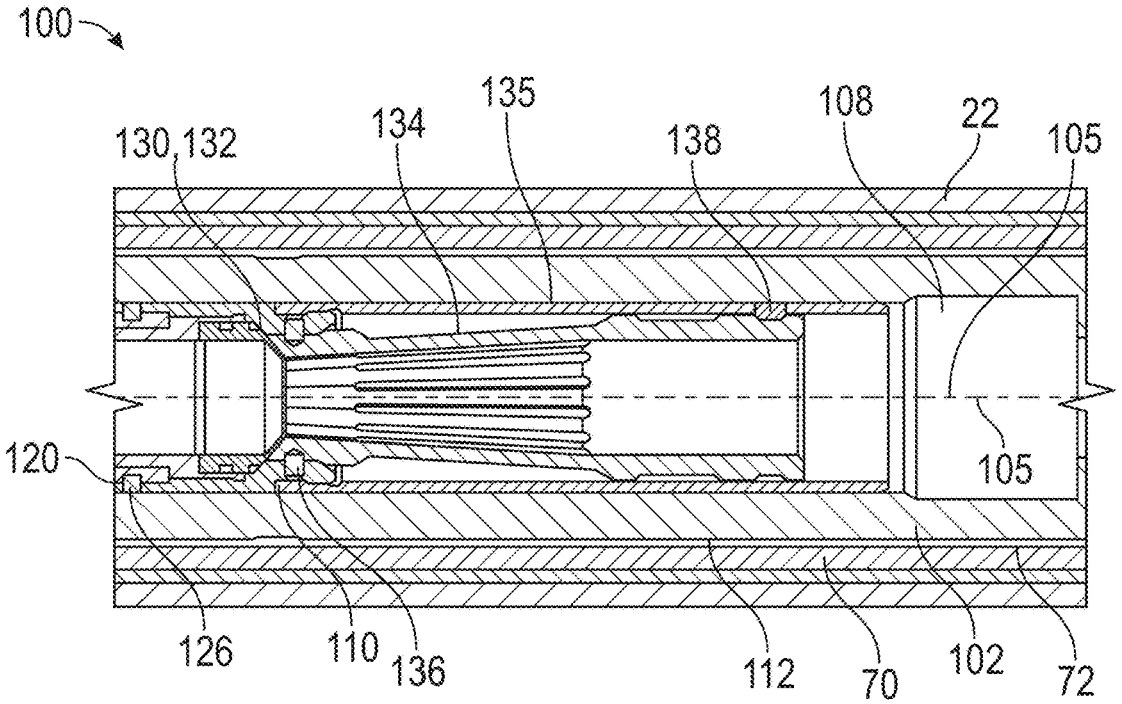
Figure 8:
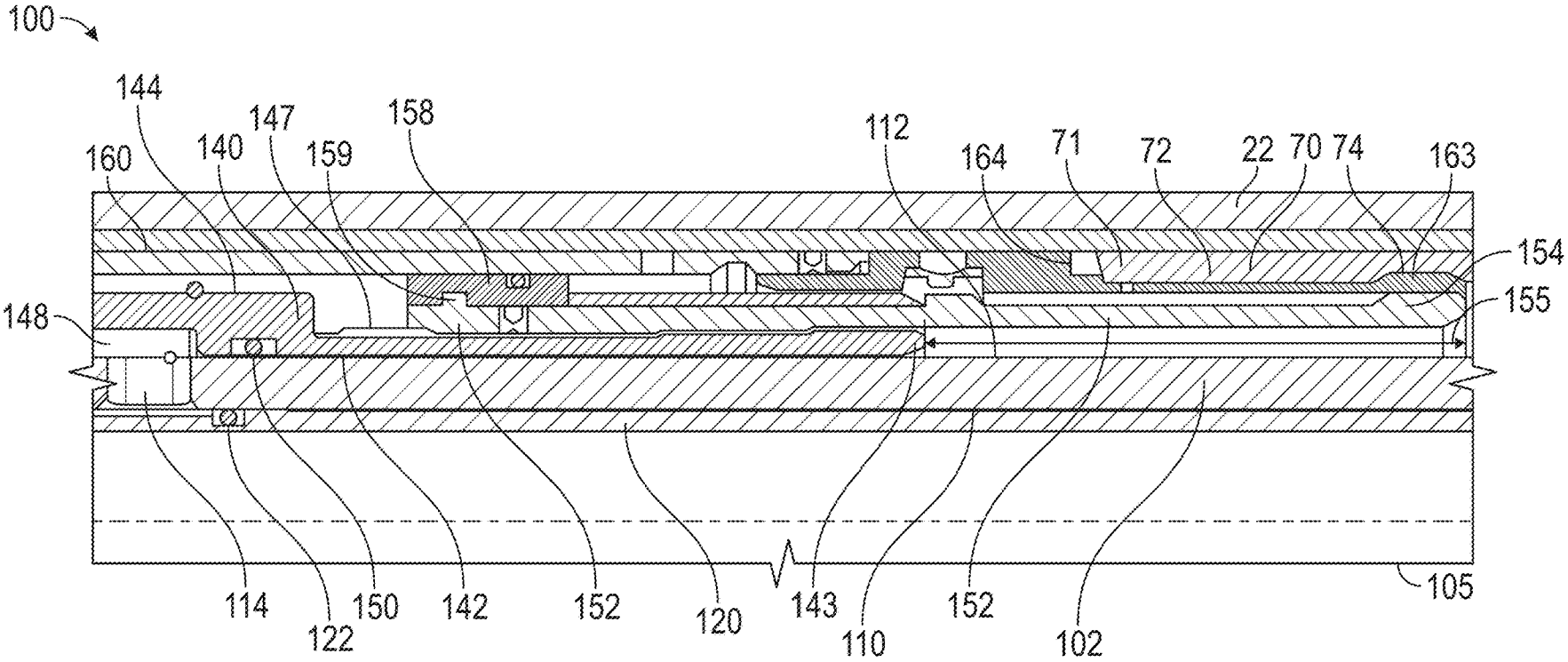
Figure 9:
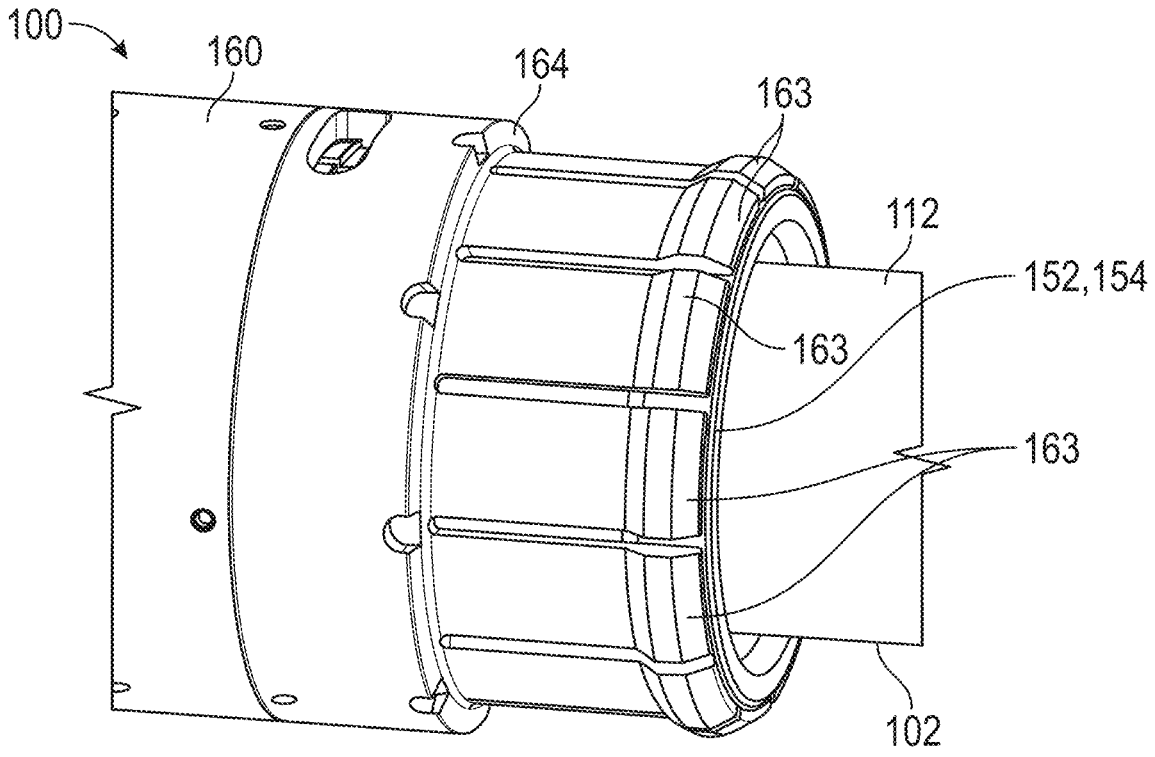
FIG. 9 is a partial perspective view of the locking tool of FIGS. 5-8.
Figure 10:
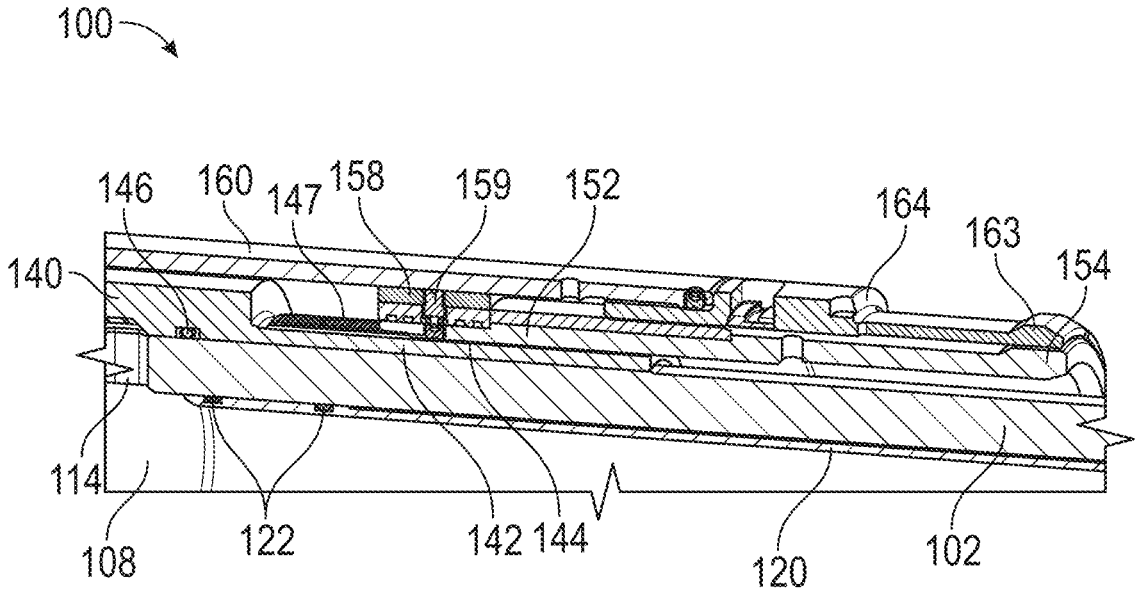
FIG. 10 is a partial, perspective cross-sectional view of the locking tool of FIGS. 5-8.

Referring to FIG. 3, well system 10 is shown following the setting or installation of liner hanger 80 in the wellbore 3. Particularly, liner hanger 80 is shown in FIG. 3 in the set configuration with slips 82 in their radially outer positions attached to the inner surface of casing string 22 and sealing element 84 in its expanded configuration in sealing engagement with the inner surface of casing string 22 thereby forming a sealed connection between the downhole end 26 of casing string 22 and the uphole end of liner hanger 80. Additionally, while conveyance string 30, locking tool 52, and setting tool 60 have each been retrieved to the terranean surface 7 in FIG. 3, bore receptacle 70 remains in the wellbore 3 coupled to liner hanger 80 and ready to seal (e.g., via sealing surface 72 thereof) against other equipment of downhole assembly 20.

Further, FIG. 3 illustrates that the minimum ID 33 of fluid passage 32 is not encumbered or reduced by the presence of components of either locking tool 52 or setting tool 60. Instead, laterally (relative central axis 25) along the interface between casing string 22 and liner hanger 80 is only the casing string 22 and the liner 86 of liner hanger 80 with no intervening equipment (e.g., pistons, mandrels, collets, and/or other equipment of a conventional locking and/or setting tool positioned radially between casing string 22 and liner hanger 80) positioned therebetween to undesirably siphon production flow area away from the fluid passage 32.

Referring now to FIGS. 4-11, another embodiment of a liner hanger system 90 is shown that includes a locking tool 100 having a central or longitudinal axis 105 and which extends between a first or uphole end 101 and a longitudinally opposed second or downhole end 103. Liner hanger system 90 may include features in common with the liner hanger system 50 shown in FIGS. 1-3. For example, liner hanger system 90 may additionally include setting tool 60, bore receptacle 70, and/or additional equipment coupled to the downhole end 103 of locking tool 100 with the uphole end 101 of locking tool 100 connectable to a downhole end of a conveyance string such as the downhole end 34 of conveyance string 30 shown in FIGS. 1-3. Thus, in some embodiments, locking tool 100 is configured to facilitate the installation of a liner hanger (e.g., liner hanger 80 shown in FIGS. 1-3) in a wellbore (e.g., wellbore 3 shown in FIGS. 1-3) using a setting tool and a bore receptacle (e.g., setting tool 60 and bore receptacle 70 shown in FIGS. 1-3) each coupled to the downhole end 103 of locking tool 100.

In this exemplary embodiment, locking tool 100 generally includes an inner body or mandrel 102, a setting piston 140 supported around the mandrel 102, a setting sleeve 160 supported around the mandrel 102, and a support sleeve 200 also supported around the mandrel 102. The Mandrel 102 of locking tool 100 extends between a first or uphole end 104 located at the uphole end 101 of locking tool 100 and a longitudinally opposed second or downhole end 106 located at the downhole end 103 of locking tool 100. Mandrel 102 may comprise a single, monolithically cylindrical member or a plurality of separate cylindrical members that are coupled together to form mandrel 102. Mandrel 102 includes a central bore or passage 108 defined by a generally cylindrical inner surface 110 extending between ends 104 and 106, and a generally cylindrical outer surface 112 similarly extending between ends 104 and 106. Fluid may be communicated longitudinally across locking tool 100 between the ends 101 and 103 thereof through the central passage 108 of mandrel 102. Additionally, mandrel 102 includes an annular seal assembly 113 positioned on the outer surface 112 thereof and in sealing contact with the setting piston 140 as will be discussed further herein.

In addition, mandrel 102 includes a first or uphole connector 107 located at the uphole end 104 thereof and a second or downhole connector 109 located at the downhole end 106 thereof. In some embodiments, connectors 107 and 109 comprise releasable connectors such as threaded connectors; however, in other embodiments, the configuration of connectors 107 and 109 may vary from that shown in FIGS. 4-9. The uphole connector 107 is configured to connect to a corresponding connector located at a downhole end of a conveyance string (e.g., conveyance string 30 shown in FIGS. 1-3) for deploying locking tool 100 into and from a wellbore (e.g., wellbore 3 shown in FIGS. 1-3). The downhole connector 109 is configured to connect to an uphole end of a setting tool of liner hanger system 90 (e.g., setting tool 60 shown in FIGS. 1-3). In this manner, fluid flow, pressure, as well as obturating members may be communicated from a surface assembly (e.g., surface assembly 12 shown in FIGS. 1-3), through the mandrel 102, and to the setting tool of liner hanger system 90 coupled thereto. In addition, axially directed forces (e.g., directed along central axis 105) and/or rotational forces (e.g., directed around central axis 105) may also be communicated from the surface assembly, through the mandrel 102, and to the setting tool of liner hanger system 90. In this exemplary embodiment, mandrel 102 comprises one or more circumferentially spaced radial ports 114 each extending radially between inner surface 110 and the outer surface 112 of mandrel 102. As will be discussed further herein, fluid pressure may be selectably communicated through radial ports 114 to drive the actuation of locking tool 100.

In this exemplary embodiment, locking tool 100 additionally includes an isolation sleeve 120 slidably received in the central passage 108 of mandrel 102 and is axially displaceable between an initial first or closed position in central passage 108 and a second or open position that is axially spaced (relative to mandrel 102) from the closed position of isolation sleeve 120. Isolation sleeve 120 comprises a pair of annular uphole seal assemblies 122 positioned on a generally cylindrical outer surface of isolation sleeve 120 proximal an uphole end of isolation sleeve 120.

The uphole seal assemblies 122 of isolation sleeve 120 axially straddle the radial ports 114 of mandrel 102 in sealing engagement with the inner surface 110 of mandrel 102 when isolation sleeve 120 is in the closed position thereby restricting fluid flow from an uphole end of central passage 108 located at the uphole end 104 of mandrel 102 through the radial ports 114 thereof. In addition, in this exemplary embodiment, isolation sleeve 120 comprises one or more annular downhole seal assemblies 124 positioned on the outer surface of isolation sleeve 120 proximal a downhole end of isolation sleeve 120. Downhole seal assembly 124 is also in sealing engagement with the inner surface 110 of mandrel 102 when isolation sleeve 120 is in the closed position.

In this exemplary embodiment, locking tool 100 additionally includes an expandable obturating member receptacle 130 also referred to herein simply as expandable ball receptacle 130 which is coupled (e.g., via a sealed connection formed therebetween) to the downhole end of isolation sleeve 120 with one or more shear members 126 (e.g., a shear pin, a shear ring) such that ball receptacle 130 is axially locked to the isolation sleeve 120. Isolation sleeve 120 may automatically shift from the closed position to the open position in response to the landing of an obturating member (e.g., obturating member 31 communicated from surface assembly 12) in the expandable ball receptacle 130 whereby a pressure differential is formed axially across expandable ball receptacle 130. The pressure differential across expandable ball receptacle forms an axially directed downhole pressure force which is applied to the expandable ball receptacle 130 and the isolation sleeve 120, thereby driving downhole axial motion of the isolation sleeve 120 (with the expandable ball receptacle 130 travelling in concert) from the closed position to the open position.

Expandable ball receptacle 130 may automatically decouple or disconnect from isolation sleeve 120 in response to the achievement of a pressure differential across the expandable ball receptacle 130 (e.g., across the obturating member landed and thereby sealed against the landing seat 132) that equals or exceeds a predefined first threshold pressure differential. The first threshold pressure differential may be based on, correlated with, a shear strength of the shear members 126 such that shear members 126 may transition from an intact state coupling expandable ball receptacle 130 with isolation sleeve 120 and a severed state severing the coupling provided by shear members 126 between expandable ball receptacle 130 and isolation sleeve 120 (permitting relative axial movement therebetween) automatically in response to the achievement of the second threshold pressure differential across expandable ball receptacle 130.

In this exemplary embodiment, expandable ball receptacle 130 generally includes a frustoconical landing seat 132 having a central opening with an expandable ID, and a collet 134 extending axially from the landing seat 132 towards a downhole end of expandable ball receptacle 130. Collet 134 is coupled and axially locked to the landing seat 132 by one or more shear members 136 (e.g., a shear pin, a shear ring) connected between the landing seat 132. In addition, collet 134 is coupled to an outer collet retainer 135 coupled to the collet 134 by one or more downhole backup members or dogs 138. Particularly, backup dog 138 is axially locked to collet retainer 135 but permitted to travel radially relative thereto. When isolation sleeve 120 is in the closed position, backup dog 138 is forced into a first or radially inner position (shown, e.g., in FIG. 7) received in a downhole groove 137 formed in a radially outer surface of collet 134 proximal the downhole end thereof.

With backup dog 138 received in downhole groove 137, relative axial movement between collet 134 and collet retainer 135 is restricted such that downhole axially directed forces applied to expandable ball receptacle 130 are transmitted through the backup dog 138 from the collet 134 to the collet retainer 135 to protect the shear member 136 from inadvertently shearing in response to the application of the one or more axially directed forces. In addition, collet 134 comprises an intermediate groove 139 also formed in the outer surface thereof and which is entirely spaced form the downhole groove 137. As will be discussed further herein, in response to isolation sleeve 120 traveling from the closed position to the open position, backup dog 138 is permitted to travel radially outwards from the radially inner position to a radial outer position axially unlocking the collet 134 from collet retainer 135 permitting the backup dog 138 to travel axially over the collet 134 until it is received in intermediate groove 139.

Expandable ball receptacle 130 may be selectably transitioned (e.g., via control signals provided by a surface pump such as fluid pump 16) between the contracted configuration and an expanded configuration. Particularly, in the contracted configuration of expandable ball receptacle 130, obturating members (e.g., obturating member 31) may land against landing seat 132 and thereby apply a downhole, axially directed force against the expandable ball receptacle 130 and the isolation sleeve 120 coupled therewith via shear members 126. Conversely, in the expanded configuration, the ID of landing seat 132 expands (e.g., to a second ID that is greater than a first ID corresponding to the contracted state) whereby the obturating member previously landed thereagainst may pass through the central opening of landing seat 132 and travel entirely through the central passage 108 of mandrel 102 towards equipment coupled to the downhole end 103 of locking tool 100 such as a setting tool (e.g., setting tool 60) whereby control signals may be passed to the downhole equipment through the central passage 108 of mandrel 102. In this exemplary embodiment, the uphole end of collet 134 axially overlaps or is stabbed into the central opening of landing seat 132 to reduce the ID of landing seat 132 when expandable ball receptacle 130 is in the contracted configuration. Conversely, in the expanded configuration, the uphole end of collet 134 is axially spaced from (e.g., downhole from) the central opening of landing seat 132 such that the ID thereof is increased or expanded.

Expandable ball receptacle 130 may be configured to automatically shift from the contracted configuration to the expanded configuration upon the achievement of a pressure differential across the expandable ball receptacle 130 that equals or exceeds a predefined second threshold pressure differential. The second threshold pressure differential may be based on, correlated with, a shear strength of the shear members 136 such that shear members 136 transition from an intact state (coupling collet 134 with landing seat 132 for shear members 136) and a severed state severing the couplings provided by shear members 136 to permit relative axial movement between collet 134/collet retainer 135 and the landing seat 132 automatically in response to the achievement of the second threshold pressure differential across expandable ball receptacle 130. In some embodiments, the second pressure differential is greater than the first pressure differential such that shear members 136 will only transition to the severed state following the transitioning of shear members 126 to the severed state.

Mandrel 102 is slidably received in a central bore or passage of the setting piston 140 of locking tool 100 and which extends longitudinally between a first or uphole end 141 and an opposed second or downhole end 143. Additionally, setting piston 140 includes a generally cylindrical inner surface 142 extending between ends 141 and 143, and a generally cylindrical outer surface 144 similarly extending between ends 141 and 143. Setting piston 140 may comprise a single, monolithically cylindrical member or a plurality of separate cylindrical members that are coupled together to form setting piston 140.

Setting piston 140 comprises an annular seal assembly 146 positioned on the inner surface 142 thereof. Seal assemblies 113 and 146 of mandrel 102 and setting piston 140, respectively, axially straddle the radial ports 114 of mandrel 102 with seal assembly 113 in sealing engagement with the inner surface 142 of setting piston 140 and the seal assembly 146 in sealing engagement with the outer surface 112 of mandrel 102 to define an annular expansion chamber 148 positioned radially between mandrel 102 and setting piston 140 and in fluid communication with radial ports 114. An annular shoulder is formed along the inner surface 142 of setting piston 140 that assists in defining expansion chamber 148 whereby fluid pressure within expansion chamber 148 applies an axially directed downhole pressure force against the setting piston 140, urging the setting piston 140 downhole relative to the mandrel 102.

In this exemplary embodiment, setting piston 140 is frangibly coupled to the mandrel 102 via one or more shear members 150 (e.g., shear pins, shear rings) extending radially and coupled between setting piston 140 and mandrel 102. Shear members 150 maintain setting piston 140 in a first or run-in position along central axis 105 relative to mandrel 102. Setting piston 140 may be driven or axially displaced (e.g., as a result of a pressure force applied to the shoulder of setting piston 140) from the run-in position to a second or stroked position axially spaced downhole along central axis 105 relative to the run-in position in response to the achievement of a fluid pressure in the expansion chamber 148 that equals or exceeds a predefined third fluid pressure. The third fluid pressure may be based on, correlated with, a shear strength of the shear members 150 such that shear members 150 transition from an intact state coupling setting piston 140 with mandrel 102 and a severed state severing the coupling provided by shear members 150 between setting piston 140 and mandrel 102 (permitting relative axial movement therebetween) automatically in response to the achievement of the third fluid pressure in the expansion chamber 148. In some embodiments, the third fluid pressure is greater than the uphole fluid pressure of the second pressure differential (e.g., the pressure on the uphole side of ball receptacle 130) such that shear member 150 will only transition to the severed state following the transitioning of shear members 136 to the severed state.

The locking tool 100 additionally includes, in this exemplary embodiment, an adjustable support sleeve 152 coupled to the downhole end 143 of setting piston 140 such that, during downhole operation of locking tool 100, setting piston 140 and support sleeve 152 travel axially in concert relative to mandrel 102. A downhole end of support sleeve 152 which projects axially from the downhole end 143 of setting piston 140 defines a radially outwards projecting shoulder 154. As will be discussed further herein, outer shoulder 154 of support sleeve 152 assists in axially locking the setting sleeve 160 to the bore receptacle 70 when setting piston 140 is in the run-in position such that locking tool 100 may not be disconnected from bore receptacle 70 (e.g., in response to an axially uphole directed force applied to the uphole end 104 of mandrel 102) until setting piston 140 is shifted from the run-in position towards the stroked position thereby axially shifting the support sleeve 152 in concert with the setting piston 140.

Support sleeve 152 is coupled to the setting piston 140 via an adjustable connection 147 formed between the outer surface 144 of setting piston 140 and an inner surface of support sleeve 152. For example, adjustable connection 147 may comprise a threaded connection formed between an external threaded connector of setting piston 140 and an internal threaded connector of support sleeve 152. In this configuration, the axial position of support sleeve 152 may be adjusted relative to setting piston 140 prior to deploying locking tool into the wellbore. For example, by rotating support sleeve 152 relative to setting piston 140 an axial distance or length 155 (shown in FIG. 8) between the downhole end 143 of setting piston 140 and the downhole end of support sleeve 152 may be adjusted. Axial distance 155 may be adjusted to account for differences in the configuration of the given bore receptacle (e.g., bore receptacle 70) to which locking tool 100 is coupled as part of a given application. For instance, axial distance 155 may be adjusted to account for differences in the length of the bore receptacle to which the locking tool 100 is coupled for a given application. In this manner, locking tool 100 may be used with a broader range of bore receptacles (e.g., bore receptacles of different lengths) increasing the flexibility and adaptability of locking tool 100. However, in other embodiments, setting piston 140 and support sleeve 152 may comprise a single, integrally or monolithically formed cylindrical member. In this exemplary embodiment, locking tool 100 additionally includes an annular retainer sleeve 153 coupled to and projecting axially from the uphole end 141 of setting piston 140. In other embodiments, locking tool 100 may not include a separate retainer sleeve 153 and instead the features and functionalities of retainer sleeve 153 may be incorporated into setting piston 140. For instance, in other embodiments, setting piston 140 may be formed integrally or monolithically with retainer sleeve 153.

In this exemplary embodiment, locking tool 100 additionally includes a stroke or load limiter 158 (e.g., an annular stroke limiter) that is frangibly coupled to an uphole end of the support sleeve 152 by a shear member 159 (e.g., shear pins, shear rings). Particularly, shear members extend radially between a radially outer surface of support sleeve 152 and a radially inner surface of stroke limiter 158 with stroke limiter 158 positioned around the uphole end of support sleeve 152. As will be discussed further herein, stroke limiter 158 is configured to contact or engage the setting sleeve 160 when the setting piston 140 is shifted from the run-in position towards the stroked position whereby axially directed forces (e.g., downhole and/or uphole directed) may be applied to the bore receptacle 70 hydraulically (e.g., via the operation of fluid pump 16) through the locking tool 100.

The axially directed forces applied to bore receptacle 70 may be used to activate or set equipment of the liner hanger (e.g., liner hanger 80) coupled to the downhole end of bore receptacle 70. For example, the axially directed forces applied to bore receptacle 70 through the locking tool 100 may be used to set one or more slips (e.g., slips 82) and/or sealing element (e.g., sealing element 84). The setting of the slips and the sealing element may be performed sequentially in some embodiments such as, for example, with the slips being set at a point in time prior to the setting of the sealing element. In some embodiments, the shear members 159 coupling stroke limiter 158 with support sleeve 152 are configured to yield following the setting of the first component (e.g., the one or more slips) but prior to the setting of the second component (e.g., the sealing element) to prevent the premature setting of the second component. For example, in some embodiments, the shear members 159 may be configured to transition automatically from an intact state coupling and axially locking the stroke limiter 158 with the support sleeve 152 to a severed state that severs the connection between stroke limiter 158 and support sleeve 152 in response to the achievement of a fluid pressure in expansion chamber 148 that is greater than the pressure required to set the first component (e.g., the one or more slips) but less than the pressure required to set the second component (e.g., the sealing element).

The setting sleeve 160 of locking tool 100 interfaces directly with the bore receptacle 70 (or other bore receptacles in other applications) whereby control signals such as axially directed forces in the uphole and/or downhole directions may be communicated through the locking tool 100 and bore receptacle 70 to the liner hanger coupled therewith whereby one or more slips and a sealing element of the liner hanger may be set. Particularly, in this exemplary embodiment, locking tool 100 includes an initial first or locked state in which setting sleeve 160 is axially locked to a bore receptacle (e.g., bore receptacle 70) such that locking tool 100 may not be disconnected from bore receptacle 70 or the liner hanger coupled therewith. In the locked state of locking tool 100, axially directed forces may be communicated between setting sleeve 160 and bore receptacle 70 both in an uphole direction and an opposing downhole direction.

Additionally, locking tool 100 includes a subsequent second or unlocked state in which setting sleeve 160 is axially unlocked from bore receptacle 70 such that locking tool 100 may be disconnected from bore receptacle 70/the liner hanger coupled therewith in response to applying an axially uphole directed, predefined disconnection force to the uphole end 104 of the mandrel 102 of locking tool 100. However, in this exemplary embodiment, while uphole directed axial forces may not generally be transferred between bore receptacle 70 and setting sleeve 160 when locking tool 100 is in the unlocked state, downhole axially directed forces may still be applied from the setting sleeve 160 to the bore receptacle 70 as part of communicating control signals downhole to install the liner hanger coupled to the bore receptacle 70 (e.g., for installing a packer or sealing element of the liner hanger following installation of one or more slips of the liner hanger). Thus, even when relative axial motion is permitted between setting sleeve 160 and bore receptacle 70 with locking tool 100 in the unlocked state, axially directed forces may still be transferred between setting sleeve 160 and bore receptacle 70 (e.g., downhole axially directed forces applied from setting sleeve 160 to bore receptacle 70).

Setting sleeve 160 is positioned around both the mandrel 102 and setting piston 140 and has a first or uphole end 161 and a longitudinally opposed second or downhole end 163. In this exemplary embodiment, the downhole end 163 defines a radially outwards projecting locking shoulder and thus may also be referred to herein as locking shoulder 163. Particularly, in this exemplary embodiment, the downhole end of setting sleeve 160 comprises a plurality of the locking shoulders 163 (shown in FIG. 9) in the form of radially flexible collet fingers circumferentially spaced around the central axis 105 of locking tool 100. In this configuration, locking shoulders 163 each have a radially outer position relative to central axis 105 locking bore receptacle 70 to setting sleeve 160 and a radially inner position that axially unlocks bore receptacle 70 from setting sleeve 160 where locking shoulders 163 may be biased (e.g., mechanically biased) towards their respective radially outer positions. However, the configuration of locking shoulder 163 may vary in other embodiments.

The locking shoulder 163 of setting sleeve 160 is received in a corresponding annular groove 74 formed along the sealing surface 72 of bore receptacle 70 (or another similarly configured bore receptacle) when the locking shoulder 163 is in the radially outer position to axially lock the setting sleeve 160 to the bore receptacle 70. In addition, in this exemplary embodiment, a radially outer surface of setting sleeve 160 defines an annular load shoulder 164 axially spaced from locking shoulders 163 and configured to apply downhole axially directed forces against an annular uphole end 71 of the bore receptacle 70. Load shoulder 164 increases the contact surface area when applying downhole axially directed loads against bore receptacle 70 to thereby reduce stresses imparted to the uphole end 71 of bore receptacle 70 during the installation thereof in wellbore 3.

In this exemplary embodiment, locking tool 100 additionally includes a floating sleeve 170 slidably positioned around the mandrel 102 but at least partially within the setting sleeve 160. and coupled or pinned to the uphole end 161 of setting sleeve 160. The uphole end 161 of setting sleeve 160 couples to floating sleeve 170 via an adjustable connection 172 formed between a radially outer surface of floating sleeve 170 and an inner surface of setting sleeve 160. For example, adjustable connection 172 may comprise a threaded connection formed between an external threaded connector of floating sleeve 170 and an internal threaded connector of setting sleeve 160. In this configuration, the axial position of setting sleeve 160 may be adjusted relative to mandrel 102 and/or setting piston 140 by rotating floating sleeve 170 relative to setting sleeve 160 prior to deploying locking tool 100 into the wellbore. For example, the axial position of setting sleeve 160 may be adjusted to account for manufacturing limitations (e.g., in terms of precision) and tolerance stack-up. In other embodiments, locking tool 100 may not include floating sleeve 170 and instead the uphole end 161 of setting sleeve 160 may instead directly slidably engage or contact the outer surface 112 of mandrel 102.

Locking tool 100 further comprises one or more radially displaceable locking members or dogs 180 receivable in an annular groove 116 formed along the outer surface 112 of mandrel 102 and configured to delimit or prevent downhole axial travel of the setting sleeve 160 relative to the mandrel 102. In some embodiments, locking tool 100 comprises a plurality of the locking dogs 180 circumferentially spaced around central axis 105. In some embodiments, locking dogs 180 comprise one or more inclined or profiles surfaces which engage or contact corresponding inclined or profiles surfaces of annular groove 116 which may urge or bias the locking dog 180 radially outwards in response to the application of axially directed forces and/or axial motion to mandrel 102. Particularly, the relative axial force and/or motion may urge the locking dogs 180 from first or radially inner positions restricting relative axial movement between the locking dogs 180 and the mandrel 102 and second or radially outer positions permitting relative axial movement between locking dogs 180 and mandrel 102. In this exemplary embodiment, with setting piston 140 in the run-in position, the retainer sleeve 153 axially overlaps at least partially enclosing the locking dogs 180 restricting the locking dogs 180 from shifting to their radially outer positions. Such that locking dogs 180 remain axially locked to mandrel 102.

In their radially inner positions, locking dogs 180 collectively define a load shoulder that is engageable or contactable by a downhole end 174 (shown in FIG. 6) of floating sleeve 170. Particularly, contact between the downhole end 174 of floating sleeve 170 and the load shoulder formed by locking dogs 180 delimits or prevents downhole axial travel of setting sleeve 160 relative to mandrel 102 whereby setting sleeve 160 is maintained in a first or run-in position relative to mandrel 102. In this configuration, a load path 177 (shown in FIG. 6) is established that extends between the mandrel 102 and the setting sleeve 160 via the locking dogs 180 when locking dogs 180 are in their radially inner positions. However, load path 177 is eliminated when locking dogs 180 are in their radially outer positions whereby loads (e.g., axially directed loads) may not be transferred between the mandrel 102 and setting sleeve 160 through the locking dogs 180.

Particularly, in this exemplary embodiment, load path 177 extends from setting sleeve 160 to the floating sleeve 170 via the adjustable connection 172 formed therebetween. Additionally, the load path 177 extends from floating sleeve 170 (slidably positioned or "floating" around the mandrel 102) to the locking dogs 180 (in their radially inner positions) via engagement between the downhole end 174 of floating sleeve 170 and locking dogs 180 which are axially locked to mandrel 102. The load path 177 then extends from locking dogs 180 to the mandrel 102. For instance, in this manner, an uphole axially directed force applied by the surface assembly 12, for example, may be communicated along conveyance string 30 and to the uphole end 104 of the mandrel 102 of locking tool 100 coupled therewith. This uphole axially directed force applied to mandrel 102 is transmitted along the load path 177 as a corresponding uphole axially directed force that is applied to the uphole end 161 of setting sleeve 160. Conversely, a downhole axially directed force may be applied to the setting sleeve 160 (e.g., from bore receptacle 70 when setting sleeve 160 is axially locked therewith with outer shoulder 154 of support sleeve 152 radially supporting or locking the locking shoulders 163 in their radially outer positions) that is transmitted along load path 177 to the mandrel 102 where the transmitted force is applied as a corresponding downhole axially directed force to the mandrel 102 via forcible engagement between the downhole end 174 of floating sleeve 170 and the load shoulder formed by locking dogs 180.

However, in this exemplary embodiment, a downhole axially directed force may not be transmitted from mandrel 102 along load path 177 to the setting sleeve 160 (and from the setting sleeve 160 to the bore receptacle 70 coupled to the downhole end 163 of setting sleeve 160) as downhole axially directed loads may only be transmitted across the interface formed between the downhole end 174 of floating sleeve 170 and the load shoulder formed by locking dogs 180 (when locking dogs 180 are in their radially inner positions) from floating sleeve 170 (and hence setting sleeve 160) to the mandrel 102 but not from the mandrel 102 to the setting sleeve 160/floating sleeve 170.

Similarly, uphole axially directed forces may only be transmitted across the interface formed between the downhole end 174 of floating sleeve 170 and the load shoulder formed by locking dogs 180 (when locking dogs 180 are in their radially inner positions) from mandrel 102 to setting sleeve 160/floating sleeve 170 but not from the setting sleeve 160/floating sleeve 170 to the mandrel 102. In this manner, downhole axially directed forces inadvertently applied to locking tool 100 during operation (e.g., inadvertent downhole axially directed forces applied to conveyance string 30 at the surface assembly 12, vibration of locking tool 100 in the wellbore 3) may not be inadvertently transmitted to the setting sleeve 160 (and hence the bore receptacle 70) which could result in the presetting of the liner hanger (e.g., at a location in the wellbore 3 other than the intended deployment location) coupled to bore receptacle 70. Additionally, as described above, when locking dogs 180 are in their radially outer positions the load shoulder formed by locking dogs 180 and hence load path 177 are each eliminated such that setting sleeve 160 is permitted to travel axially downhole relative to mandrel 102 (e.g., via the urging of setting piston 140) from the run-in position of setting sleeve 160 to downhole axially directed loads and/or to drive or displace bore receptacle 70 axially downhole relative to other components of the liner hanger system comprising locking tool 100 such as one or more slips and/or a sealing element of the liner hanger of the liner hanger system.

Having described the structural features of different embodiments of liner hanger systems and the locking tools thereof, embodiments of methods or processes for setting liner hangers will now be described. In some embodiments, the methods discussed below may be implemented using the embodiments described above such as liner hanger system 50 shown in FIGS. 1-3 and the liner hanger system 90 shown in FIG. 4.

Figure 11:
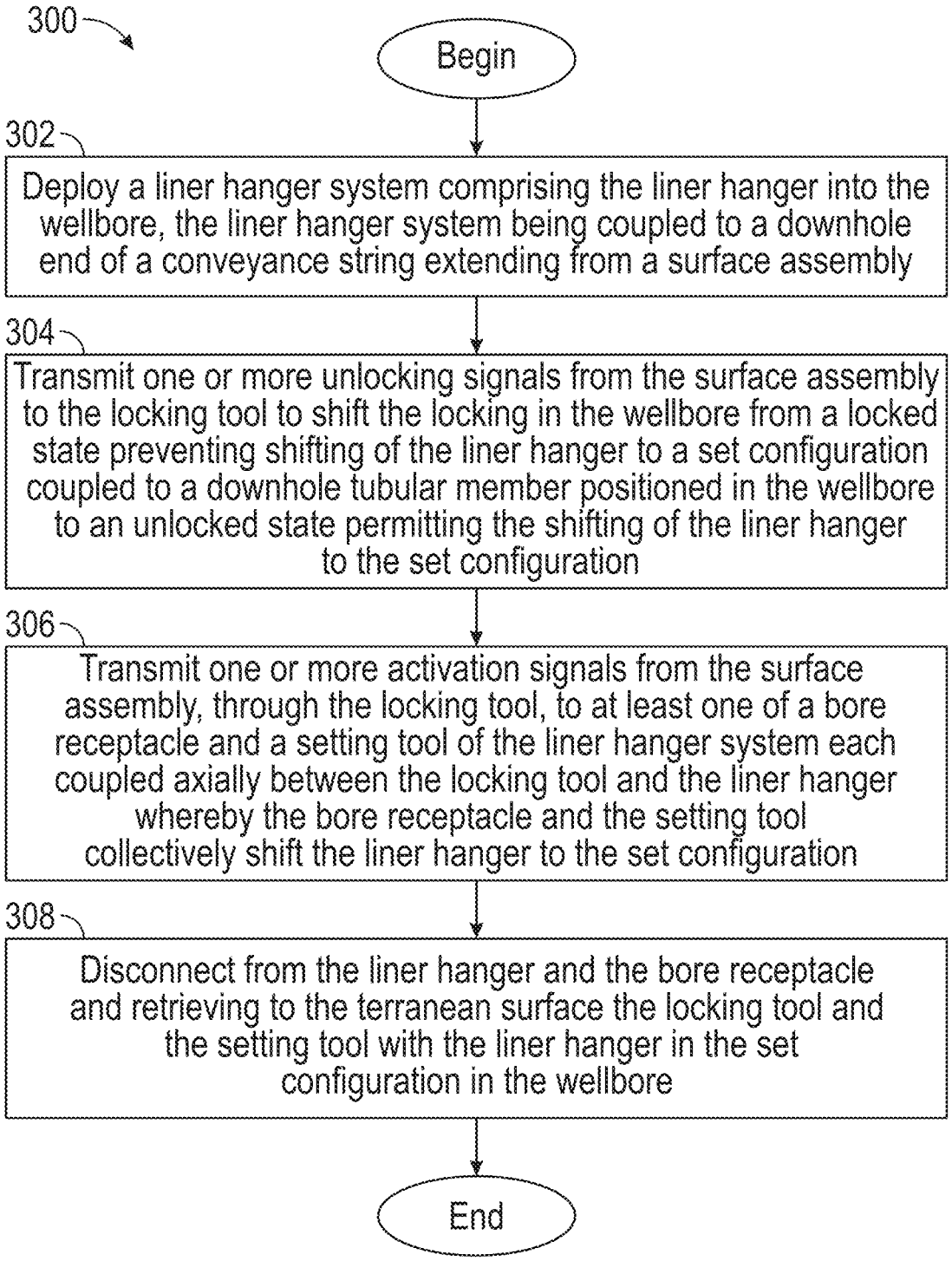
FIG. 11 is a flow chart of an embodiment of a method for installing a liner hanger in a wellbore penetrating an earthen subterranean formation in accordance with principles disclosed herein.
Figure 12:
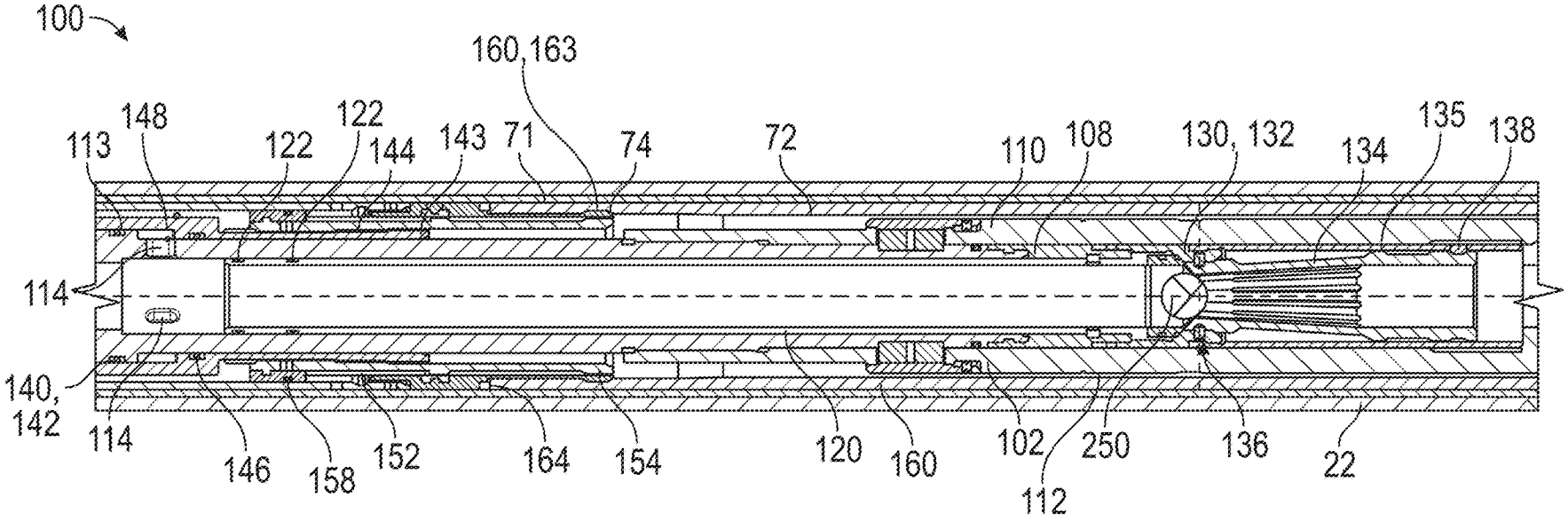
FIGS. 12-16 are additional side cross-sectional views of the locking tool of FIGS. 5-8.
Figure 13:
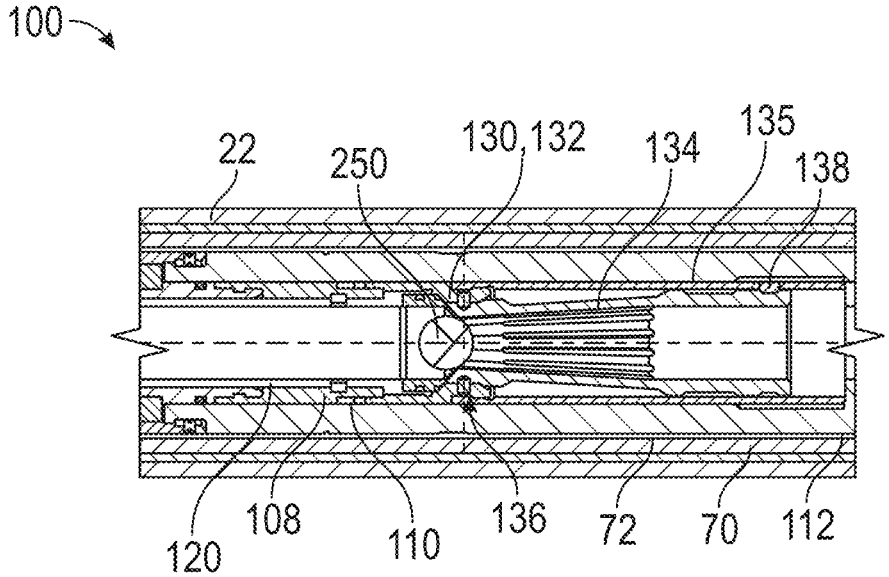
Figure 14:
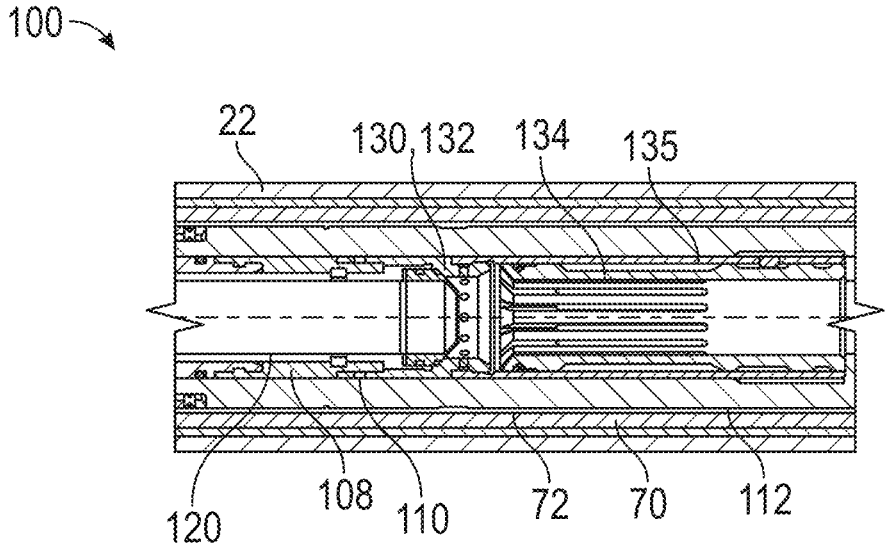

Particularly, and referring now to FIG. 11, an embodiment of a method for installing a liner hanger (e.g., liner hanger 80 shown in FIGS. 1-3) in a wellbore (e.g., wellbore 3 shown in FIGS. 1-3) penetrating an earthen subterranean formation (e.g., subterranean formation 5 shown in FIGS. 1-3) is shown. Initially, at block 302, method 300 comprises deploying a liner hanger system (e.g., liner hanger systems 50 or 90) comprising the liner hanger into the wellbore, the liner hanger system being coupled to a downhole end of a conveyance string extending from a surface assembly. In some embodiments, block 302 comprises running (e.g., lowering, injecting) the liner hanger systems 50 or 90 into a wellbore at the downhole end of a conveyance string (e.g., conveyance string 30 shown in FIGS. 1 and 2) which may take the form of a work string formed from a plurality of separate tubular joints or pipe joints connected end-to-end, coiled tubing taking the form of a flexible, single continuous tubular member or pipe, or other means having a fluid passage whereby fluidic control signals may be transmitted (e.g., in the form of adjustments to fluid pressure, flow, and/or the communication of obturating members and similar tools) from the surface assembly to the liner hanger system.

At block 304, method 300 comprises transmitting one or more unlocking signals from the surface assembly to the locking tool to shift the locking tool in the wellbore from a locked state preventing shifting of the liner hanger to a set configuration coupled to a downhole tubular member positioned in the wellbore to an unlocked state permitting the shifting of the liner hanger to the set configuration. In some embodiments, the one or more unlocking signals comprise one or more mechanical signals where "mechanical signal," "mechanical control signal," and the like refers to in this application a force communicated to the liner hanger system mechanically from the terranean surface such as axially directed forces and/or rotational torques applied to an uphole end of the conveyance string by the surface assembly and which are transmitted mechanically through the conveyance string to the liner hanger system.

In certain embodiments, the one or more unlocking signals comprise one more hydraulic signals (or a combination of hydraulic and mechanical signals) where "hydraulic signal," "hydraulic control signal," and the like refers to in this application a force communicated to the liner hanger system fluidically from the terranean surface such as fluid pressures and/or flow rates of the fluid passage extending from the surface assembly to the liner hanger system. Hydraulic signals may also include signals that involve the communication of obturating members (e.g., balls, darts, and the like) from the surface assembly downhole through the downhole fluid passage and to the liner hanger system where the obturating member may be sealably landed to seal the downhole fluid passage thereat to augment pressure control (e.g., increase the fluid pressure that may be practicably achieved downhole within the liner hanger system via a fluid pump of the surface assembly) within the liner hanger system.

In some embodiments, block 304 comprises flowing an obturating member (e.g., obturating member 31 shown in FIG. 2) from a surface assembly (e.g., surface assembly 12) through a downhole fluid passage (e.g., fluid passage 32 shown in FIGS. 1 and 2). For example, and referring to FIGS. 12-15, block 304 may comprise flowing an obturating member or ball 250 from a surface assembly (e.g., surface assembly 12 using fluid pump 16) through a conveyance string (e.g., conveyance string 30) connected to the uphole end 104 of the mandrel 102 of locking tool 100 (e.g., comprising a component of liner hanger system 90 shown in FIG. 4) in a first or run-in configuration in which isolation sleeve 120 is in the closed position, setting piston 140 is in the run-in position, locking dogs 180 are in their radially inner positions, and setting sleeve 160 is in the run-in position.

In some embodiments, ball 250 may land against the landing seat 132 of expandable ball receptacle 130 (shown in FIG. 12) causing an obstruction to fluid flow axially through locking tool 100. For example, ball 250 may seal against landing seat 132 whereby fluid communication across the interface formed between landing seat 132 and ball 250 is restricted. With ball 250 landed against landing seat 132, a hydraulic control signal in the form of an opening signal may be communicated from the surface assembly, through the conveyance string, and to the central passage 108 of mandrel 102 at the uphole end 104 thereof. This opening signal may be in the form of a predefined threshold fluid pressure exposed to the central passage 108 of mandrel 102 configured to impart a downhole axially directed force to the isolation sleeve 120 (through the ball 250 and expandable ball receptacle 130) driving the isolation sleeve 120 through central passage 108 from the closed position to the open position whereby a downhole end of collet 134 collides with an internal shoulder or other feature of the inner surface 110 of mandrel 102 thereby arresting further downhole travel of collet 134 through central passage 108. Fluid pressure within central passage 108 achieved by the opening signal may then apply a shear force sufficient to shear or shift each of the shear members 126 (shown in FIG. 13) from their intact states to their severed states whereby collet 134 and the collet retainer 135 coupled therewith are driven axially through central passage 108 transitioning expandable ball receptacle 130 from the contracted configuration to the expanded configuration.

In this example, collet 134 and collet retainer 135 are driven downhole in concert until the downhole end of collet retainer 135 collides with an internal shoulder or other feature of the inner surface 110 of mandrel 102 resulting in backup dog 138 entering a groove or relief 119 formed in the inner surface 110 of mandrel 102 which permits the backup dog 138 to displace (e.g., in response to the urging by collet 134) radially outwards into its radially outer position to axially unlock collet 134 from collet retainer 135. Particularly, with backup dog 138 received in groove 119, collet 134 is permitted to travel downhole axially relative to collet retainer 135 until the downhole end of collet 134 until similarly colliding with the shoulder or other feature of inner surface 110 to arrest the downhole travel of collet 134 with backup dog 138 received in intermediate groove 139. In this configuration, radial ports 114 of mandrel 102 are now exposed to the central passage 108 thereof whereby fluid pressure may be communicated from the surface assembly to the expansion chamber to apply a downhole axially directed pressure force against the setting piston 140.

Figure 15:
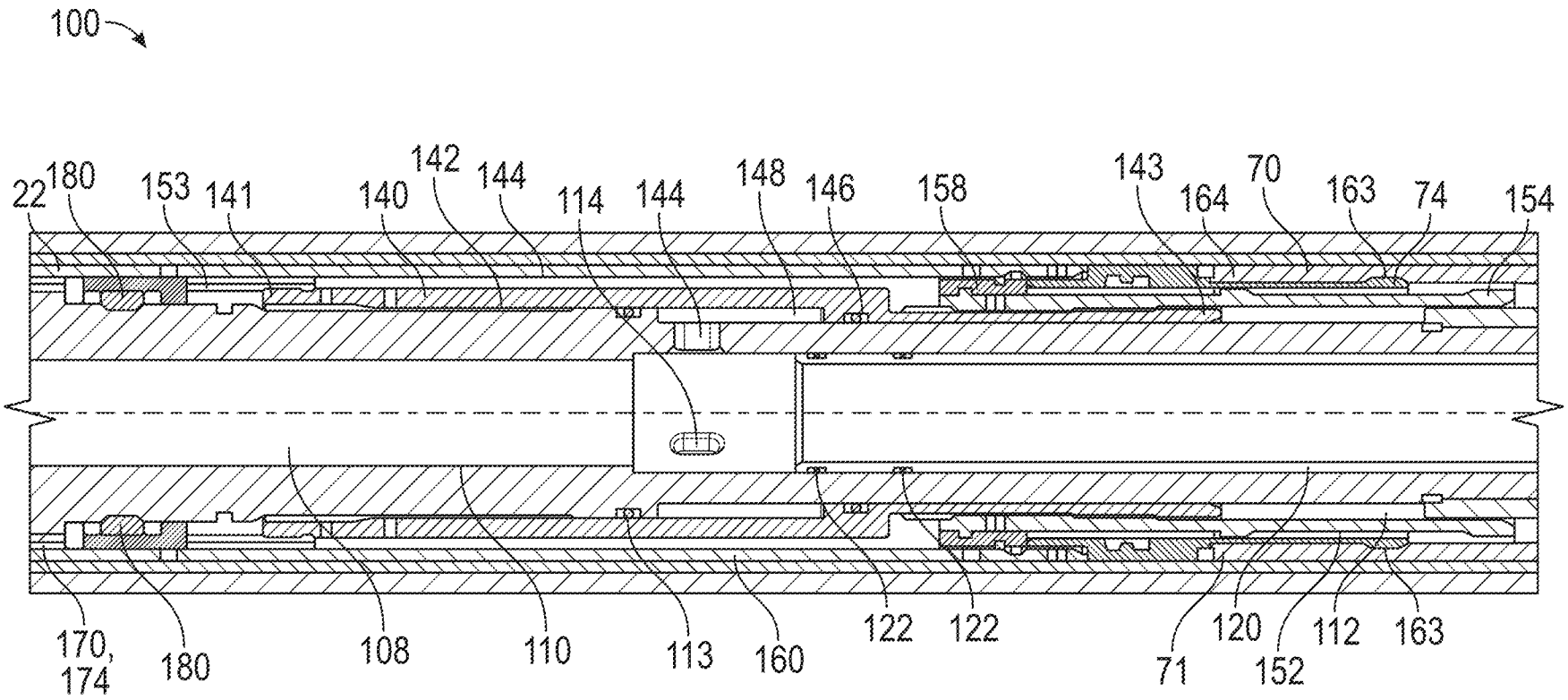

As shown particularly in FIG. 15, in this example, another control signal may be communicated from the surface assembly to the locking tool 100 such as a hydraulic control signal in the form of an actuation or shifting signal may be communicated from the surface assembly, through the conveyance string, and to the central passage 108 of mandrel 102 at the uphole end 104 thereof. This shifting signal may be in the form of a predefined threshold fluid pressure exposed to the expansion chamber configured to impart a downhole axially directed force to the setting piston 140 sufficient to shear or shift each of the shear members 150 from their intact states to their severed states whereby setting piston 140 is disconnected or axially unlocked from mandrel 102 such that setting piston 140 is permitted to travel relative to the mandrel 102 downhole axially from the run-in position towards the stroked position thereof. In some embodiments, the threshold fluid pressure sufficient to shear the shear members 150 is greater than the threshold fluid pressure sufficient to shift the isolation sleeve 120 from the closed position to the open position and/or to shear the shear members 126, and/or 136.

With setting piston 140 now axially unlocked from mandrel 102, continued application of the shifting signal from the surface assembly to locking tool 100 drives the setting piston downhole axially relative to mandrel 102 whereby the retainer sleeve 153 coupled to the uphole end 141 thereof travels downhole in concert with the setting piston 140, axially uncovering the locking dogs 180 (e.g., such that retainer sleeve 153 does not axially overlap and is entirely axially spaced from locking dogs 180) such that locking dogs 180 are permitted to shift from their radially inner positions to their radially outer positions. With locking dogs 180 axially uncovered from retainer sleeve 153, locking tool 100 is placed transitioned into the unlocked state whereby setting sleeve 160, no longer blocked by a load shoulder formed by locking dogs 180 in their radially inner positions, is permitted to travel axially downhole relative to mandrel 102 to facilitate the transmission of control signals downhole from the setting sleeve 160, through the bore receptacle 70, and to the liner hanger coupled therewith for setting the liner hanger (e.g., in conjunction with a setting tool coupled to the downhole end 106 of mandrel 102) in the wellbore.

In addition, in the unlocked state of locking tool 100, the locking shoulders 163 of setting sleeve 160 are unsupported by the outer shoulder 154 of support sleeve 152, thereby permitting an uphole axially directed force applied from the surface assembly to the locking tool 100 to disconnect the locking tool 100 from the bore receptacle 70 via flexing the locking shoulders 163 into their radially inner positions removed from groove 74 of bore receptacle 70. In some embodiments, the control signals described above (e.g., the opening signal, the shifting signal) communicated from the surface assembly to locking tool 100 for shifting locking tool 100 from the locked state to the unlocked state collectively define the one or more unlocking signals of block 304.

In certain embodiments, unlocking signals other than hydraulic control signals may be used to disconnect the locking tool 100 from the bore receptacle 70 and the liner hanger coupled therewith. For example, in some embodiments, mechanical control signals such as axially directed forces and/or rotational torques may be applied to a surface assembly, communicated through or along a conveyance string, to the locking tool 100. For instance, in some embodiments, if locking tool 100 is unable to release from the bore receptacle 70 in response to the application of one or more hydraulic control signals to locking tool 100, locking tool 100 may be counter-rotated by the surface assembly or rotated in the opposing rotational direction from which locking tool 100 may be rotated when deployed into the wellbore. In some embodiments, in addition to being counteracted by the surface assembly, weight is applied by the surface assembly through the conveyance string and locking tool 100 to the setting tool coupled therewith to perform an emergency release of the locking tool 100/setting tool from the bore receptacle 70/liner hanger. In some embodiments, the emergency release of the locking tool 100 results in simultaneous axial unlocking or release of the locking tool 100 and the setting tool coupled therewith from the bore receptacle 70.

Returning to FIG. 11, at block 306, method 300 comprises transmitting one or more activation signals from the surface assembly, through the locking tool, to at least one of a bore receptacle and a setting tool of the liner hanger system each coupled axially between the locking tool and the liner hanger whereby the bore receptacle and the setting tool collectively shift the liner hanger to the set configuration. In some embodiments, the one or more activation signals comprise hydraulic signals communicated from the surface assembly to the locking tool while in other embodiments the activation signals comprise one or more mechanical signals while in still other embodiments the activation signals comprise both one or more mechanical signals and one or more hydraulic signals.

In certain embodiments, the setting tool and the bore receptacle may act in concert to set the liner hanger whereby, for example, the bore receptacle may apply downhole axially directed forces to the liner hanger at the same time as the setting tool (coupled to a downhole end of the locking tool) applies an uphole axially directed force to the liner hanger to axially compress one or more slips of the liner hanger to set these components of the liner hanger. In some embodiments, downhole axially directed forces may be applied via hydraulic control signals communicated to and through the locking tool and/or via mechanical control signals also applied to and through the locking tool (e.g., through an inner mandrel of the locking tool). Additionally, in certain embodiments, uphole axially directed forces may be applied via mechanical control signals also applied to and through the locking tool (e.g., through an inner mandrel of the locking tool).

Figure 16:
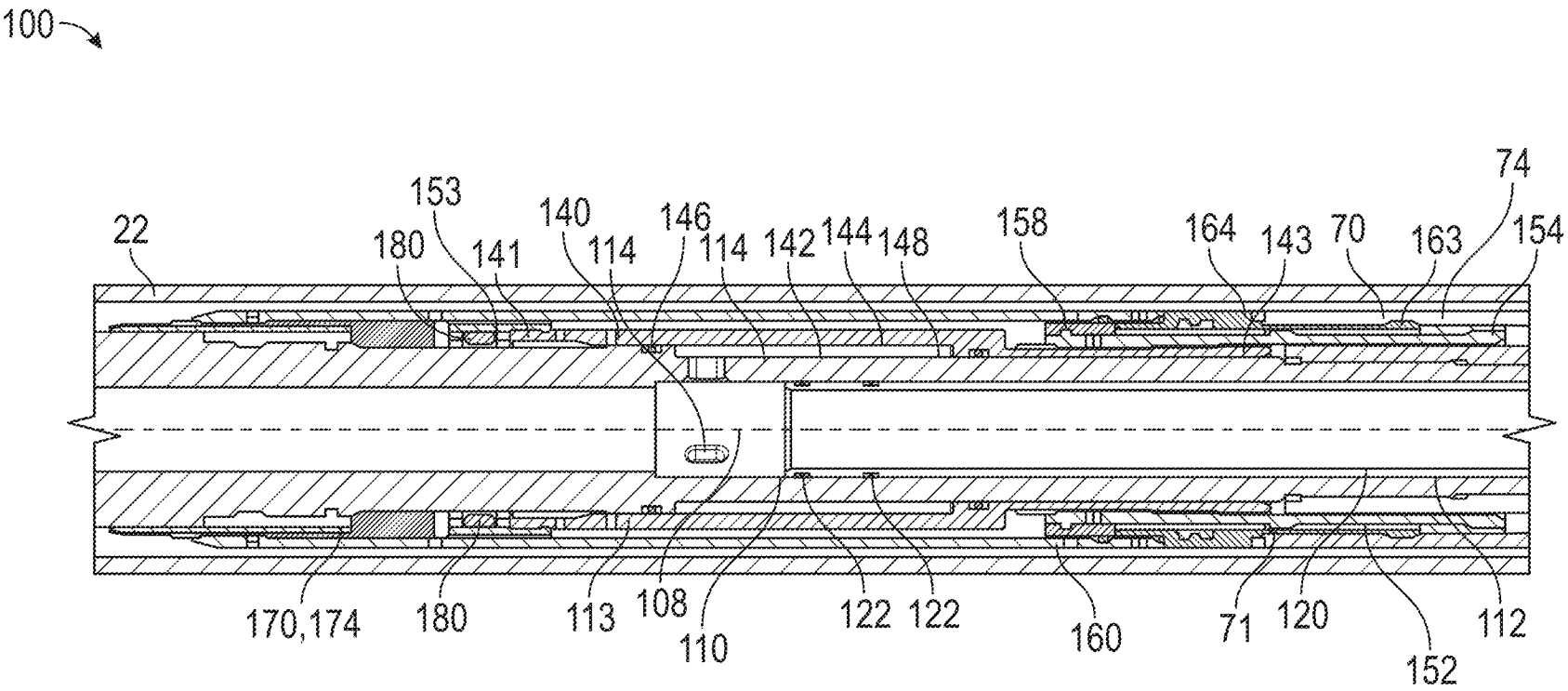

Referring to FIGS. 11 and 16, in some embodiments, block 306 comprises transmitting one or more activation signals in the form of hydraulic control signals transmitted from a surface assembly, through a conveyance string, and to the locking tool 100 for applying a downhole axially directed force to setting piston 140 sufficient for driving setting piston 140, along with setting sleeve 160 and bore receptacle 70, axially downwards to set one or more slips of a liner hanger coupled to the locking tool 100. In some embodiments, the one or more hydraulic control signals may be a continuation of the shifting signal described above (e.g., the shifting signal and the hydraulic control signal may comprise the same predefined threshold pressure applied to central passage 108 of mandrel 102) or may follow directly following the termination of the shifting signal (e.g., as an increase in fluid pressure in the central passage 108 of mandrel 102).

In certain embodiments, the one or more activation signals include an uphole axially directed force applied by the surface assembly to an uphole end of the conveyance string whereby the uphole axially directed force is communicated through the conveyance string to the uphole end 104 of mandrel 102. This uphole axially directed force may be transmitted axially through mandrel 102 and to a setting tool coupled to the downhole end 106 thereof for communicating the uphole axially directed force to the liner hanger. In some embodiments, this uphole axially directed force is applied by the setting tool concurrently to the liner hanger with the downhole axially directed force applied to the liner hanger by bore receptacle 70.

In some embodiments, the one or more activation signals comprise one or more additional mechanical control signals transmitted from the surface assembly, through the conveyance string, and to the uphole end 104 of locking tool 100. The downhole axially directed force may be transmitted from the mandrel 102 of locking tool 100 to a setting tool coupled to the downhole end 106 of mandrel 102 whereby the downhole axially directed force may be applied by the setting tool to the uphole end 71 of the bore receptacle 70 to set a sealing element of the linear hanger coupled to bore receptacle 70. For instance, with locking tool 100 being disconnected from the uphole end 71 of bore receptacle 70, locking tool 100 may be retracted from bore receptacle 70 (e.g., via retrieving to the surface a portion of the conveyance string extending to the locking tool 100) to expose radially expandable actuator or dogs of the setting tool configured to press axially against the uphole end 71 of bore receptacle 70. However, the configuration and/or operation of the setting tool and/or the liner hanger coupled with locking tool 100 may vary in other embodiments. In some embodiments, the control signals described above communicated from the surface assembly to locking tool 100 for setting the liner hanger collectively define the one or more activation signals of block 306.

Returning again to FIG. 11, at block 308, method 300 comprises disconnecting from the liner hanger and the bore receptacle and retrieving to the terranean surface the locking tool and the setting tool with the liner hanger in the set configuration in the wellbore. In some embodiments, block 308 comprises retracting by a surface assembly a conveyance string extending from the surface assembly to the locking tool disposed in the wellbore, where the setting tool is coupled to a downhole end of the locking tool.

In certain embodiments, block 308 comprises retrieving the locking tool 100 and a setting tool coupled therewith (e.g., to the downhole end 106 of mandrel 102) from the bore receptacle 70 and the liner hanger coupled therewith. The locking tool 100/setting tool may be retrieved to the surface by, for example, retracting a conveyance string extending between a surface assembly and the locking tool 100. By retrieving both the locking tool 100 and the setting tool to the terranean surface 7, the ID of the liner hanger remaining in the wellbore may be maximized given that there is no locking tool or setting tool remaining in the wellbore axially overlapping (and thereby depriving flow area from the liner hanger) with the liner hanger and/or the bore receptacle 70 coupled therewith.

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A liner hanger system deployable in a wellbore penetrating an earthen subterranean formation, the liner hanger system comprising:

a liner hanger installable in the wellbore and comprising one or more slips each having a radially inner run-in position and a radially outer set position configured to couple the liner hanger to a downhole tubular member located in the wellbore, and a sealing element comprising a radially contracted configuration and a radially expanded configuration configured to seal against an inner surface of the downhole tubular member;

a setting tool and a bore receptacle each configured to connect to the liner hanger wherein the setting tool and the bore receptacle are collectively configured to shift the one or more slips from their radially inner run-in positions to their radially outer set positions, and the sealing element from the radially contracted configuration to the radially expanded configuration in response to receiving one or more activation signals; and a locking tool configured to connect to the setting tool and the bore receptacle whereby the setting tool and the bore receptacle are each positioned axially between the locking tool and the liner hanger with the setting tool at least partially received within the bore receptacle, wherein the locking tool is shiftable downhole between a locked state and an unlocked state;

wherein the locked state of the locking tool locks the locking tool to the bore receptacle and prevents at least one of the one or more slips from shifting from their radially inner run-in positions to their radially outer set positions and the sealing element from shifting from the radially contracted configuration to the radially expanded configuration in response to receiving the one or more activation signals;

wherein the unlocked state of the locking tool permits the shifting of the one or more slips from their radially inner run-in positions to their radially outer set positions and/or the shifting of the sealing element from the radially contracted configuration to the radially expanded configuration prevented by the locking tool when in the locked state, and wherein the unlocked state unlocks the locking tool from the bore receptacle whereby the locking tool and the setting tool is each disconnectable from the bore receptacle.

2. The liner hanger system of claim 1, wherein the locking tool blocks passage of at least one of the one or more activation signals across the locking tool to the setting tool or the bore receptacle when in the locked state, and wherein the locking tool permits the passage of the at least one of the one or more activation signals across the locking tool when in the unlocked state.

3. The liner hanger system of claim 1, wherein the locking tool and the setting tool are permitted to travel uphole relative to the bore receptacle and the liner hanger when the locking tool is in the unlocked state.

4. The liner hanger system of claim 1, wherein at least one of the one or more activation signals is hydraulic and wherein at least one of the one or more activation signals is mechanical.

5. The liner hanger system of claim 1, wherein the locking tool comprises a mandrel coupled to the setting tool and a setting sleeve positioned around the mandrel and coupled to the bore receptacle when the locking tool is in the locked state.

6. The liner hanger system of claim 5, wherein the locking tool comprises a locking shoulder that restricts relative axial movement between the mandrel and the setting sleeve when the locking tool is in the locked state and permits relative axial movement between the mandrel and the setting sleeve when the locking tool is in the unlocked state.

7. The liner hanger system of claim 5, wherein the locking tool comprises a setting piston positioned radially between the mandrel and the setting sleeve, wherein the setting piston is configured to apply a first axially directed force through the setting sleeve and the bore receptacle to the liner hanger in response to the locking tool receiving the one or more activation signals.

8. The liner hanger system of claim 7, wherein the mandrel is configured to apply a second axially directed force to the liner hanger, independent of the first axially directed force, in response to the locking tool receiving the one or more activation signals.

9. A locking tool for a liner hanger system deployable in a wellbore penetrating an earthen subterranean formation, the locking tool comprising:

a mandrel comprising an uphole end configured to couple to a conveyance string for deploying the liner hanger system into the wellbore, a longitudinally opposed downhole end configured to connect to a setting tool for setting at least one of one or more slips and a sealing element of a liner hanger of the liner hanger system, a central passage extending between the uphole end and the downhole end, and a radial port in fluid communication with the central passage;

a setting sleeve positioned around the mandrel and comprising an uphole end and a longitudinally opposed downhole end configured to connect to a bore receptacle of the liner hanger system, wherein the setting tool and the bore receptacle are collectively configured to shift one or more slips of a liner hanger of the liner hanger system from radially inner run-in positions to radially outer set positions configured to couple the liner hanger to a downhole tubular member located in the wellbore, and a sealing element of the liner hanger from a radially contracted configuration to a radially expanded configuration configured to seal against an inner surface of the downhole tubular member in response to receiving one or more control signals; and a setting piston positioned radially between the setting sleeve and the mandrel whereby an expansion chamber is formed radially between the setting piston and the mandrel and in fluid communication with the radial port, wherein the setting piston is configured, in response to pressurizing the expansion chamber via communication of a control signal to the locking tool, to apply a downhole axially directed force through the setting sleeve to the bore receptacle when the bore receptacle is connected to the locking tool.

10. The locking tool of claim 9, further comprising an isolation sleeve slidably positioned in the central passage of the mandrel, the isolation sleeve comprising a first position in the central passage sealing the radial port from the central passage and a second position in the central passage, spaced from the first position, permitting fluid communication between the central passage and the radial port.

11. The locking tool of claim 10, further comprising an expandable obturating receptacle connected to the isolation sleeve when the isolation sleeve is in the first position and disconnected from the isolation sleeve when the isolation sleeve is in the second position.

12. The locking tool of claim 9, further comprising a stroke limiter coupled to a radially outer surface of the setting piston and configured to contact a shoulder of the setting sleeve to delimit downhole travel of the setting piston relative to the mandrel.

13. The locking tool of claim 9, further comprising a support sleeve coupled to a downhole end of the setting piston by an adjustable connection configured to adjust an axial projection of a downhole end of the support sleeve relative to the downhole end of the setting piston.

14. The locking tool of claim 9, further comprising a support sleeve coupled to a downhole end of the setting piston and comprising a radially outer shoulder configured to prevent disconnection of the setting sleeve from the bore receptacle when the setting piston is in a run-in position and to permit disconnection of the setting sleeve from the bore receptacle when the setting piston is in a stroked position that is axially spaced from the run-in position relative to the mandrel.

15. The locking tool of claim 14, wherein the outer shoulder of the support sleeve axially overlaps the downhole end of the setting sleeve when the setting piston is in the run-in position and is axially spaced from the downhole end of the setting sleeve when the setting piston is in the stroked position.

16. The locking tool of claim 9, further comprising one or more locking dogs positioned radially between the setting sleeve and the mandrel, wherein the one or more locking dogs each comprise a radially inner position defining a load shoulder delimiting downhole axial travel of the setting sleeve relative to the mandrel, and a radially outer position eliminating the load shoulder.

17. A method for installing a liner hanger in a wellbore penetrating an earthen subterranean formation, the method comprising:

(a) deploying a liner hanger system comprising the liner hanger into the wellbore, the liner hanger system being coupled to a downhole end of a conveyance string extending from a surface assembly;

(b) transmitting one or more unlocking signals from the surface assembly to a locking tool of the liner hanger system to shift the locking tool in the wellbore from a locked state preventing shifting of the liner hanger to a set configuration coupled to a downhole tubular member positioned in the wellbore to an unlocked state permitting the shifting of the liner hanger to the set configuration;

(c) transmitting one or more activation signals from the surface assembly, through the locking tool, to at least one of a bore receptacle and a setting tool of the liner hanger system each coupled axially between the locking tool and the liner hanger whereby the bore receptacle and the setting tool shift the liner hanger to the set configuration; and (d) disconnecting from the liner hanger and the bore receptacle and retrieving to a terranean surface the locking tool and the setting tool with the liner hanger in the set configuration in the wellbore.

18. The method of claim 17, wherein at least one of the one or more unlocking signals and at least one of the one or more activation signals are generated by a fluid pump of the surface assembly.

19. The method of claim 18, wherein the one or more activation signals are transmitted as one or more axially directed forces through the bore receptacle to the liner hanger.

20. The method of claim 18, wherein (a) comprises transmitting one or more axially directed forces along a load path extending from an inner mandrel of the locking tool, through a load shoulder defined by one or more locking dogs of the locking tool, and to an outer setting sleeve of the locking tool slidably positioned around the inner mandrel.

* * * * *